US008668854B2

(12) United States Patent
Marshall et al.

(10) Patent No.: US 8,668,854 B2
(45) Date of Patent: Mar. 11, 2014

(54) PROCESS AND APPARATUS FOR PRODUCING NANOFIBERS USING A TWO PHASE FLOW NOZZLE

(71) Applicants: Larry Marshall, Chesterfield, VA (US); Michael Bryner, Midlothian, VA (US)

(72) Inventors: Larry Marshall, Chesterfield, VA (US); Michael Bryner, Midlothian, VA (US)

(73) Assignee: Verdex Technologies, Inc., Richmond, VA (US)

( * ) Notice: Subject to any disclaimer, the term of this patent is extended or adjusted under 35 U.S.C. 154(b) by 0 days.

(21) Appl. No.: 13/912,187

(22) Filed: Jun. 6, 2013

(65) Prior Publication Data

US 2013/0328225 A1 Dec. 12, 2013

Related U.S. Application Data

(60) Provisional application No. 61/657,016, filed on Jun. 7, 2012.

(51) Int. Cl.
*D01D 5/00* (2006.01)

(52) U.S. Cl.
USPC ..... 264/172.11; 264/103; 264/211.12; 264/211.14; 264/172.19; 264/210.8

(58) Field of Classification Search
None
See application file for complete search history.

(56) References Cited

U.S. PATENT DOCUMENTS

| | | | |
|---|---|---|---|
| 6,520,425 | B1 | 2/2003 | Reneker |
| 6,695,992 | B2 | 2/2004 | Reneker |
| 6,800,226 | B1 | 10/2004 | Gerking |
| 7,666,343 | B2 | 2/2010 | Johnson et al. |

*Primary Examiner* — Monica Huson
(74) *Attorney, Agent, or Firm* — Johan O. Brag; Innova Law, LLC

(57) ABSTRACT

The disclosure relates to an apparatus and method for producing nanofibers and non-woven nanofibrous materials from polymer melts, liquids and particles using a two-phase flow nozzle. The process comprises supplying a first phase comprising a polymer melt and a second phase comprising a pressurized gas stream to a two-phase flow nozzle; injecting the polymer melt and the pressurized gas stream into a mixing chamber within the two-phase flow nozzle wherein the mixing chamber combines the polymer flow and pressurized gas into a two-phase flow; distributing the two-phase flow uniformly to a converging channel terminating into an channel exit wherein the converging channel accelerates the two-phase flow creating a polymeric film along the surface of the converging channel and fibrillating the polymeric film at the channel exit of the converging channel in the form of a plurality of nanofibers.

10 Claims, 21 Drawing Sheets

VIEW A-A

VIEW B-B

VIEW B-B

VIEW A-A

PROCESS AND APPARATUS FOR PRODUCING NANOFIBERS USING A TWO PHASE FLOW NOZZLE

PRIOR APPLICATION

This application is the continuation of provisional application 61/657,016

TECHNICAL FIELD

The disclosure relates to an apparatus and process for producing nanofibers from polymer melts using a two-phase flow nozzle.

BACKGROUND

New applications require nanofibers produced from a variety of materials including polymer melts, nanoparticles such as carbon nanotubes and liquid solutions. The diameters of such fine fibers can range in size from submicron to several microns depending on the functional requirements. There is also increased demand for loading various drugs and other active ingredients into fine fibers for the production of topical or systemic wound dressings, sublingual or oral drug delivery systems. There are several methods for producing small diameter fibers using high-volume production methods, such as flash-spinning, island-in-sea, and melt-blowing. However, the usefulness of the above methods is restricted by combinations of narrow material ranges, high costs and difficulty in producing submicron diameter fibers.

Electrospinning is a simple and well established process for producing fine fibers from solutions. Electrospinning is a process for submicron scale polymer-based filament production by means of an electrostatic field and solvent evaporation. The principal limitations of electrospinning are a very low productivity and the use of organic solvents which are difficult and costly to fully remove. Electrospinning is not well suited to produce fine fibers from fiber forming materials such as polymer melts as the much higher viscosity requires greater electrical fields leading to arcing. Electrospinning of solutions with high loading of particles is also very difficult. Drug loading is always a problem and loads greater than 5% are difficult to achieve with electrospinning. Furthermore, high drug/particle loading will often result the uneven distribution of the drug/particle in the electrospun fine fiber matrix resulting in initial burst effects. See *Electrospun nanofibers-based drug delivery systems. D G Yu et al. Health I* (2009). Despite the versatility and popularity of electrospinning, high-voltage electrical fields, sensitivity to variability in solution conductivity, low production rate, solvent based processing and difficulty in drug loading limit its application.

Rotary-jet spinning is another method in the early development stage which seeks to overcome some of the above listed limitations of electrospinning of nanofibers. U.S. Pat. No. 7,134,857 to Andrady et al. The method uses a high-speed rotating nozzle to form a polymer jet which undergoes extensive stretching before solidification. The system consists of a reservoir containing a polymer in solution with two side wall orifices that was attached to the shaft of a motor with controllable rotation speed. The outward radial centrifugal force stretches the polymer jet as it is projected toward a collector wall, but the jet travels in a diffuse trajectory due to rotation-dependent inertia. Concurrently, the solvent in the polymer solution evaporates, solidifying and contracting the jet.

Another problem with the processing of polymers into fine fibers is that such processes generally involve organic solvents which can be highly toxic and damaging to the environment. Flash-spinning, jet-spinning, electrospinning and electro-blown spinning typically require that the polymer be dissolved in a solvent. While manufacturing processes typically involve the removal of organic solvents, such processes require specially equipped manufacturing facilities. Additionally, small quantities of organic solvents still remain and may leach from the fibers over time. Such solvent residues can be problematic in sensitive biological applications. The limited availability of ecologically friendly manufacturing processes has been a major barrier to the greater use of biodegradable polymers in the medical field. There is therefore a need for a production process capable of producing fine fibers of controllable diameter size and distribution without the use of organic solvents.

Several research efforts have involved the formation of fine fibers directly from melts. One important advantage of creating fine fibers from polymer melts is that the dissolution of polymers in organic solvents and the subsequent removal/recycling of solvents are no longer required. Meltblowing processes manage the separate flow of process gases, such as air, and polymeric material through a die body to effect the formation of the polymeric material into continuous or discontinuous fiber. In most known configurations of meltblowing nozzles, hot air is provided through a passageway formed on each side of a die tip. The hot air heats the die and thus prevents the die from freezing as the molten polymer exits and cools. In this way the die is prevented from becoming clogged with solidifying polymer. In addition to heating the die body, the hot air, which is sometimes referred to as primary air, acts to draw, or attenuate the melt into elongated micro-sized filaments. In some cases, a secondary air source is further employed that impinges upon the drawn filaments so as to fragment and cool the filaments prior to being deposited on a collection surface. Meltblown fibers are known to consist of fiber diameters of 1 to 10 microns. Further reduction of meltblown fiber size to submicron ranges is typically difficult, requiring a combination of smaller capillary size, lower polymer throughput per capillary, increased number of capillaries per die width to compensate for the lower throughput, specialized polymer rheology, and control of polymer cooling temperature as filaments solidify. (See *Melt blown nanofibers: Fiber diameter distributions and onset of fiber breakup, Christopher J. Ellison, Alhad Phatak, David W. Giles, Christopher W Macosko, Frank S. Bates, Polymer* 48 (2007) 3306-3316)

U.S. Pat. Nos. 5,260,003 and 5,114,631 to Nyssen, et al., both hereby incorporated by reference, describe a meltblowing process and device for manufacturing ultra-fine fibers and ultra-fine fiber mats from polymers with mean fiber diameters of 0.2-15 microns. Laval nozzles are utilized to accelerate the process gas to supersonic speed; however, the process as disclosed has been realized to be prohibitively expensive both in operating and equipment costs. U.S. Pat. No. 6,800,226 to Gerking, hereby incorporated by reference, teaches a method and a device for the production of essentially continuous fine threads made of meltable polymers. The polymer melt is spun from at least one spin hole and the spun thread is attenuated using gas flows which are accelerated to achieve high speeds by means of a Laval nozzle. The air is rapidly accelerated as it passes the converging section of the nozzle. The polymer melt is attenuated by the air jet until the fiber bursts open and disintegrates into a multitude of finer filaments. Nonwoven fabrics made of fibers with diameters from 2 to 5 microns have been successfully fabricated using this process.

More recently, methods of forming fibers with fiber diameters less than 1.0 micron, or 1000 nanometers, have been developed. These fibers are often referred to as ultra-fine fibers, sub-micron fibers, or nanofibers. Methods of producing nanofibers are known in the art and often make use of a plurality of multi-fluid nozzles, whereby an air source is supplied to an inner fluid passageway and a molten polymeric material is supplied to an outer annular passageway concentrically positioned about the inner passageway. One such process, referred to as melt-film fibrillation includes the steps of utilizing a central fluid stream to form an elongated hollow polymeric film tube and using high velocity air to shear multiple nanofibers from the hollow tube.

U.S. Pat. No. 6,382,526 and U.S. Pat. No. 6,520,425 to Reneker, et al., both hereby incorporated by reference, disclose such a melt film fibrillation process for producing nanofibers. Fiber forming material is forced concentrically into a thin annular film around an inner concentric passageway of pressurized gas. This film is subjected to shearing deformation by an outer concentric gas jet until it reaches the fiber-forming material supply tube outlet. At this point, expansion of this inner pressurized gas stream is said to eject the "fiber-forming material from the exit orifice of the annular column in the form of a plurality of strands of fiber-forming material that solidify and form nanofibers having a diameter up to about 3,000 nanometers.

U.S. Pat. No. 4,536,361 to Torobin, incorporated herein by reference, teaches a similar microfiber formation method wherein a coaxial blowing nozzle has an inner passageway to convey a blowing gas at a positive pressure to the inner surface of a liquid film material, and an outer passageway to convey the film material. The combined action of the expansion of the blowing gas and an entraining fluid jet impinging at a transverse angle fracture the film to form microfibers. Drawbacks of the film fibrillation processes are that they require multiple pressurized gas streams which complicate nozzle design and they do not readily produce fibers smaller than meltblown fibers. There is therefore a need for a production process capable of producing submicron fibers of controllable diameter size and distribution from polymer melts.

There is also a need for producing fine fiber webs of high uniformity and loft.

Additionally, there is a need for a high-throughput process capable of producing large numbers of fine fibers per spinning nozzle.

SUMMARY

The subject matter of the present disclosure is directed to the production of fine fibers of controllable fineness in a single step, high throughout process, and a novel two-phase flow nozzle device used for this purpose. Highly uniform materials comprised of nonwoven webs of fine fibers have been produced at commercial scale throughputs. Increased pore size materials combined with high surface area are also produced by the present disclosure. With the present disclosure, high quality, nanofibrous nonwoven products having improved thermal and liquid barrier properties, uniformity, loft, absorbency, resistance to compression and high surface area are provided that are suitable for a large variety of industrial and biomedical care fibrous products.

The present inventors have surprisingly found that nonwoven materials with high loft and uniformity, comprising a high proportion of fine fibers, can be produced without the use of organic solvents in a single step, highly scalable production process.

The disclosure is directed to an apparatus and method for forming fine fiber webs from polymer melts. The operative mechanism is to combine and mix both the fiber forming polymer melt and the working pressurized gas stream into a two phase flow within a spinning nozzle, upstream of the nozzle exit, and to pass this two phase flow through a long narrow channel of high length to width ratio, such that the polymer eventually forms a film on the walls of the channel. The film is thinned by the gas flow and is split into filaments at the nozzle exit.

A polymer melt heated and stirred to the desired spinning temperature and heated ambient air are pressurized and fed into a mixing means within the spin nozzle. There the polymer melt and the heated pressurized gas are mixed to create a two-phase flow. The multi-phase flow is then forced through a film forming channel exiting through an annular exit orifice. In one embodiment, the mixing means is a centrifugal two-phase chamber and the film forming channel is a converging conical geometry. The accelerating gas flow within the converging channel creates thin polymeric film layers on both sides of the converging channel. Upon exit from the nozzle the film layers are sheared into multi-fibrous strands of fibers with controllable fineness collected on a collector at a set distance from the tip of the nozzle.

One aspect of the inventive subject matter is to provide an apparatus and method for producing biocompatible non-woven fibrous webs without the use of organic solvents.

Another aspect of the inventive subject matter is to produce non-woven fibrous webs with fibers with a median diameter of less than 1 micron in economical and commercially viable quantities.

A further aspect of the inventive subject matter is to produce fine fiber webs with high loft and porosity for industrial and medical uses.

A further aspect of the present disclosure is to provide an apparatus and method for the production of uniform submicron fiber webs.

In yet another aspect, the disclosure provides a method and apparatus for producing a fibrous web of fine fibers which exhibits increased surface area, higher porosity and loft over that previously available and which does not pose the health concerns associated with fibers produced with organic solvents.

In a further aspect, the disclosure provides a method of making on nonwoven fibrous web, including the steps of:

a) supplying a first phase comprising a polymer melt and a second phase comprising a pressurized gas stream to a two-phase flow nozzle;
b) injecting the polymer melt and the pressurized gas stream into a mixing chamber within the two-phase flow nozzle wherein the mixing chamber combines the polymer flow and pressurized gas into a two-phase flow;
c) distributing the two-phase flow uniformly to a converging channel terminating into an channel exit wherein the converging channel accelerates the two-phase flow creating a polymeric film along the surface of the converging channel;
d) fibrillating the polymeric film at the channel exit of the converging channel in the form of a plurality of nanofibers.
e) collecting the fibers on a collector such as a screen or moving belt at a set distance of the spin nozzle exit orifice.

In another embodiment, a method for the production of a non-woven nanofibrous web from melted polymers comprises the steps of:

a) heating and stirring a polymer in a reactor vessel to a spinning temperature above the melting temperature the polymer;

b) feeding ambient air through a pressurization line to establish a head pressure on the melted polymer;
c) opening a valve forcing the melted and pressurized polymer out of the reactor vessel through the valve and then through a filter into a spin nozzle;
d) injecting a heated, pressurized gas through ports of a two-phase chamber of the spin nozzle into said two-phase chamber creating a rotational flow;
e) injecting the polymer into a mixing chamber through multiple orifices equally spaced around a cylindrical polymer feed tube;
f) forcing the two-phase air-polymer flow through a converging channel;
g) creating polymeric film layers on both sides of the converging channel;
h) shearing the polymeric film layers into fibers wherein the fiber fineness corresponds to the thickness of the polymeric film layers;
i) collecting the fibers on a screen or moving belt at a set distance of the spin nozzle exit orifice.

In an additional aspect, the disclosure provides a method and apparatus for producing a non-woven fibrous web with high uniformity, high porosity, large pore size and high surface area.

In various exemplary embodiments, the two-phase nozzle, apparatus, and method of the present disclosure may permit production of nonwoven fibrous webs containing fine fibers with a narrow distribution in fiber diameter. Other exemplary embodiments of the present disclosure may have structural features that enable their use in a variety of applications; may have exceptional absorbent and/or adsorbent properties; may have exceptional thermal resistance, may exhibit high porosity, high fluid permeability, and/or low pressure drop when used as a fluid filtration medium and may be manufactured in a cost-effective and efficient manner.

In other exemplary embodiments, the disclosure provides a process and apparatus for the production of relatively strong composite fibrous webs of discontinuous fibers made of polymeric materials, which fibrous webs contain significant amounts of fine fibers suitably dispersed for use as high efficiency filtration media to purify water and other fluids.

In other exemplary embodiments, the disclosure provides an apparatus and method to make high efficiency polymeric composite filtration media incorporating fine fibers which incur relatively low pressure losses associated with the flow of water and other liquids through such media.

In still further embodiments, the disclosure provides a process and apparatus for the production of relatively strong composite fibrous webs of discontinuous fine fibers.

Another advantage of some preferred embodiments of the disclosure is to allow the production of commercial quantities of fine fibers in a manner which avoids the use of organic solvents and which can be employed as at least one of the following media: superabsorbent biodegradable wound care dressings, drug delivery patches, tissue engineering scaffolds, biofiltration membranes.

Another aspect of some preferred embodiments of the disclosure is to prepare nonwoven fibrous webs containing particles i such nanoparticles which are anchored sufficiently in the webs to minimize their subsequent detachment, for example, during the passage of liquids or air through the webs.

In further embodiments, the disclosure provides an apparatus and method to prepare a non-woven fibrous web containing nanoparticles for use as a wound care dressing, in which such nanoparticles are suitably dispersed so as to produce a wound care product with superior small particle holding ability.

In still further embodiments, the disclosure provides a process which allows the creation of a non-woven fibrous web which minimizes the clumping together and clustering of nanoparticles in a wound care dressing.

In still further embodiments, the disclosure provides a process a process which allows the creation of a non-woven fibrous web reinforced with carbon nanotubes in a manner which overcomes the low mechanical strength of the non-woven fibrous web.

In yet further embodiments, the disclosure provides a process to make polymeric/nanoparticle composite media incorporating nanoparticles with efficiencies high enough to eliminate the need for separate coating of the fine fiber web, thereby avoiding the costs of coating the fibers and the potential loss of filtration or drug delivery efficiency which results from the loss of coated media of while it is in storage or in use.

Another object of some preferred embodiments of this disclosure is to make polymeric composite non-woven fibrous webs incorporating nanoparticles which can be released in a controlled manner over time to extend and maintain the effect of particle delivery or filtration, and to reduce the burst effect from high nanoparticle loading.

In still another aspect, the disclosure relates to methods of production of biodegradable filtration media which avoid the high cost and potential for pollution of solvents.

In still another embodiment, the disclosure relates to polymeric/nanoparticle composite filtration media incorporating different polymers and nanoparticles in an economical manner.

Various aspects and advantages of exemplary embodiments of the present disclosure have been summarized. The above summary is not intended to fully describe or limit each illustrated embodiment or every implementation of the present disclosure. The Drawings and the Detailed Description that follow more particularly exemplify certain preferred embodiments using the principles disclosed herein.

DETAILED DESCRIPTION

Fiber Forming Two Phase Flow Nozzle

Figure 1:
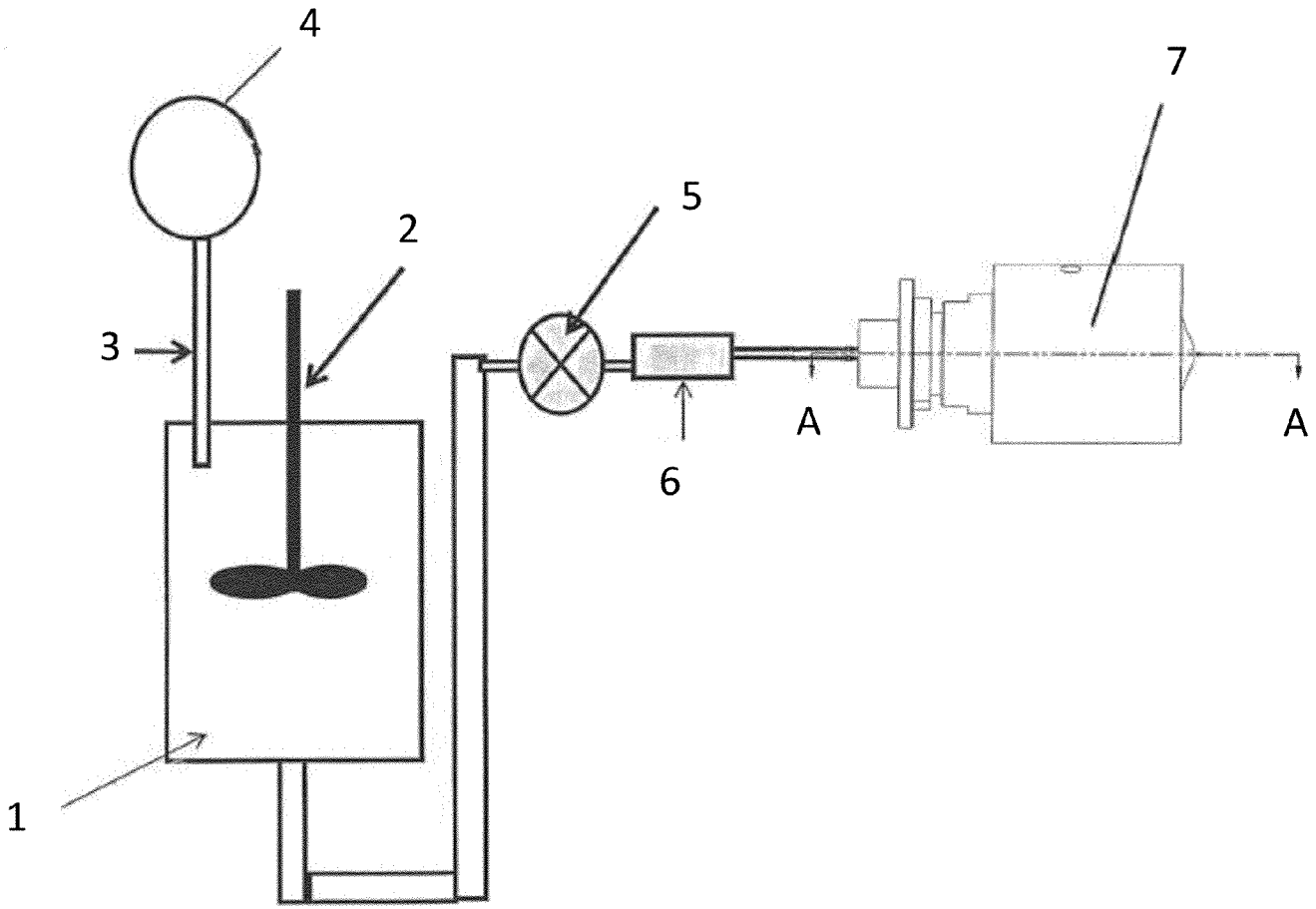
FIG. 1 is a generalized view of a process to produce nanofibers according the present disclosure.

Melt film fibrillation nozzles described in the prior art differ from the fiber forming nozzles in the current disclosure in how the fibers are made and the starting melt geometry from which a fibrous web is produced. Melt film fibrillation processes of the prior art start with a single phase polymer flow that is impinged by a separate working air stream. The polymer melt film tube is thinned to a polymer film from the shearing action of the air stream. The polymer stream and the working air streams are combined externally to the nozzle at the nozzle exit. The shearing action of the inner gas stream and the effect of the outer gas stream produces a multiplicity of fibers.

In contrast, the process of the current disclosure utilizes a mixing chamber to produce a two-phase polymer-gas mixture within the fiber-forming nozzle. The two-phase flow under pressure is then uniformly distributed to and forced through a film forming channel of high length to width ratio. This two phase flow of polymer and working gas in the same narrow long channel within the spin nozzle before the nozzle exit is a novel feature of the disclosure. Without being bound by theory, it is believed that in the long narrow channel, the higher viscosity polymer phase forms a film along both surfaces of the channel while the air separates and is forced through the center of the channel. The long narrow channel geometry and control of the magnitude and ratio of polymer melt and gas flows determine the thickness and other attributes of the polymer film. Upon exiting the channel, these in combination with the aerodynamic forces of the gas jet cause the polymer film to disintegrate into a multitude of finer filaments. The thinner the polymer film upon exit from the film forming channel, the finer the ultimate fibers produced. Thus, by varying the polymer flow rate and the gas velocity, it is possible to control film thickness and hence the fine fiber diameter.

In one embodiment the mixing chamber is a two-phase chamber and the long narrow film forming channel has a converging conical geometry. Heated pressurized air, together with a polymer melt under pressure are both injected into the two-phase chamber where the mixture combines to form a two-phase flow. The rotational two phase flow in the two-phase chamber is converted into an axial flow along the length of a narrow converging conical channel. As the converging flow geometry decreases flow area, the accelerating gas velocity in turn increases shearing forces on the polymer film as the polymer progresses along the channel tending to thin the polymer film. However, that same converging flow geometry reduces the wall area supporting the polymer film which tends to increase the film thickness. Balancing these opposed effects offers unique control over the resulting fiber size and the fiber size distribution.

Apparatus and System for Forming Nanofibrous Materials

The present disclosure relates to apparatus and methods for forming non-woven nanofibrous materials. The non-woven nanofibrous materials are formed from one or more thermoplastic polymers. Generally suitable polymers include any polymers suitable for melt spinning. The melting temperature is generally from about 25 C to 400 C. Nonlimiting examples of thermoplastic polymers include polypropylene and copolymers, polyethylene and copolymers, polyesters, polyamides, polystyrenes, biodegradable polymers including thermoplastic starch, PHA, PLA, PCL, PLGA, polyurethanes, and combinations thereof. Preferred polymers are PCL, PLA, PLGA and other biodegradable linear aliphatic polyesters. Optionally, the polymer may contain additional materials to provide additional properties for the fiber. These may modify the physical properties of the resulting fiber such as elasticity, strength, thermal or chemical stability, appearance, liquid absorbency, surface properties, among others. A suitable hydrophilic melt additive may be added. Optional materials may be present up to 50% of the total polymer composition. It may be desired to use a mixture of lower and higher molecular weight polymers in a web. The lower molecular weight polymer will fibrillate easier which may result in fibers having different diameters. If the polymers will not blend, separate nozzles may be utilized for the different molecular weight polymers.

The average fiber diameter of a significant number of fibers in the fine fiber layer of the web can be less than one micron and preferably from about 0.1 microns to 1 micron, more preferably from about 0.5 microns to about 0.9 microns. The basis weight of the fine fiber layer can be less than about 25 gsm, commonly from about 0.1 to about 15 gsm, preferably less than 10 gsm or 5 gsm. The fine fiber layer may have a basis weight in the range of from about 0.5 to about 3 gsm or from about 0.5 to about 1.5 gsm, depending upon use of the nonwoven web.

Process for Producing Uniform Fibers

Current fiber spinning methods such as melt spinning, electrospinning, flash spinning, etc., deposit fibers with a mass distribution centered on the fiber issuing orifice because the probability of fiber deposition is highest at the point of fiber generation. The conical pack of the current disclosure avoids this problem because fiber generation and deposition are distributed uniformly around the circumference of a circle. The result of deposition on a moving take-up device from a single nozzle is a nominally uniform mass profile across the width of the deposition circle.

The laws of physics make it increasingly difficult to distribute mass uniformly from a single fiber generating nozzle as throughput increases. This is because more work, faster is required for distribution as throughput increases. This is not the case with the conical pack. Because of the geometry the uniformity of fiber distribution is nominally independent of throughput. The nozzle of the current disclosure provides therefore a unique capability to make uniform webs from a single nozzle at high throughput.

While current film fibrillation methods typically produce non-uniform non-woven fibrous web, a more uniform fibrous web may be desirable for application such as drug delivery or wound care. A uniform fibrous web may have more controllable and predictable drug or active agent release characteristics. Web uniformity can be measured through several methods. (See description of uniformity index (UI) in U.S. Pat. No. 7,118,698 to Armantrout et al). Example 21 deposits fibers with mass distribution centered on the fiber issuing orifice, such as other nonwoven processes; however, the technology of this disclosure lends itself to the design of a fiber forming nozzle with a conical, hollow laydown wherein the fiber generation and deposition are distributed uniformly around the circumference of a circle (see FIG. 32). Examples of uniformity metrics include low coefficient of variation of pore diameter, basis weight, air permeability, and/or thermal resistance. Uniformity may also be evaluated by the hydrohead or other liquid barrier measurement of the web. The relative distribution of microfibers in the non-woven fibrous web depends on the application and the polymer used. Certain thermoplastic polymers such as PCL offer greater compression resistance and elasticity retaining its original shape after compression. The table below compares the uniformity levels of non-woven materials produced with the method of the current disclosure to other nonwoven materials. The uniformity of the produced materials with the methods of the current disclosure approaches that of films. In a preferred embodiment the UI of the material produced is between 2 and 6.

| NON-WOVEN | UNIFORMITY INDEX |
|---|---|
| TYVEK | 18 |
| Melt-blown | 10 |
| Kraft paper | 7 |
| Films | 2 |
| Disclosure | 2-6 |

Method for Spinning Nanofibers into Non-Woven Materials

Figure 4:
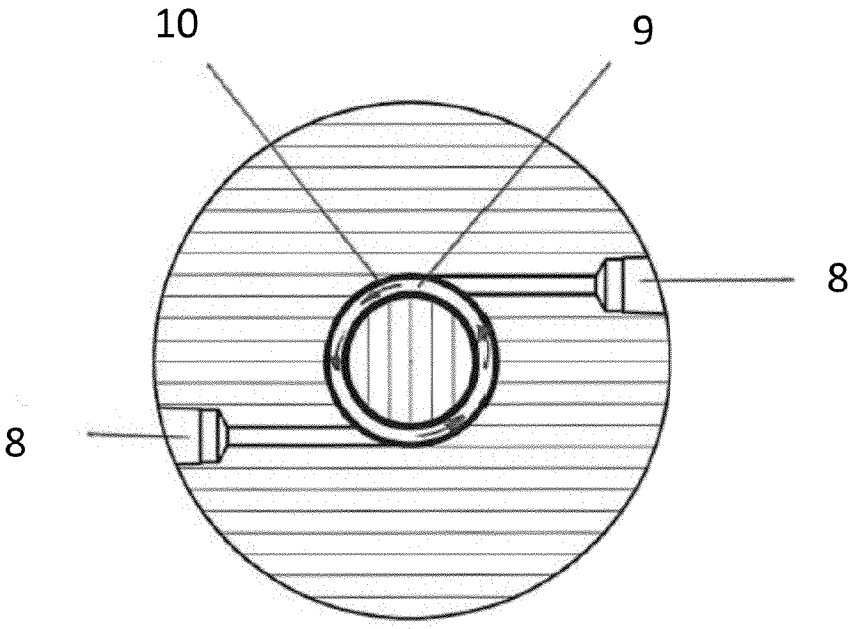
FIG. 4 is cross-sectional view of a mixing chamber according to the disclosure.
Figure 5:
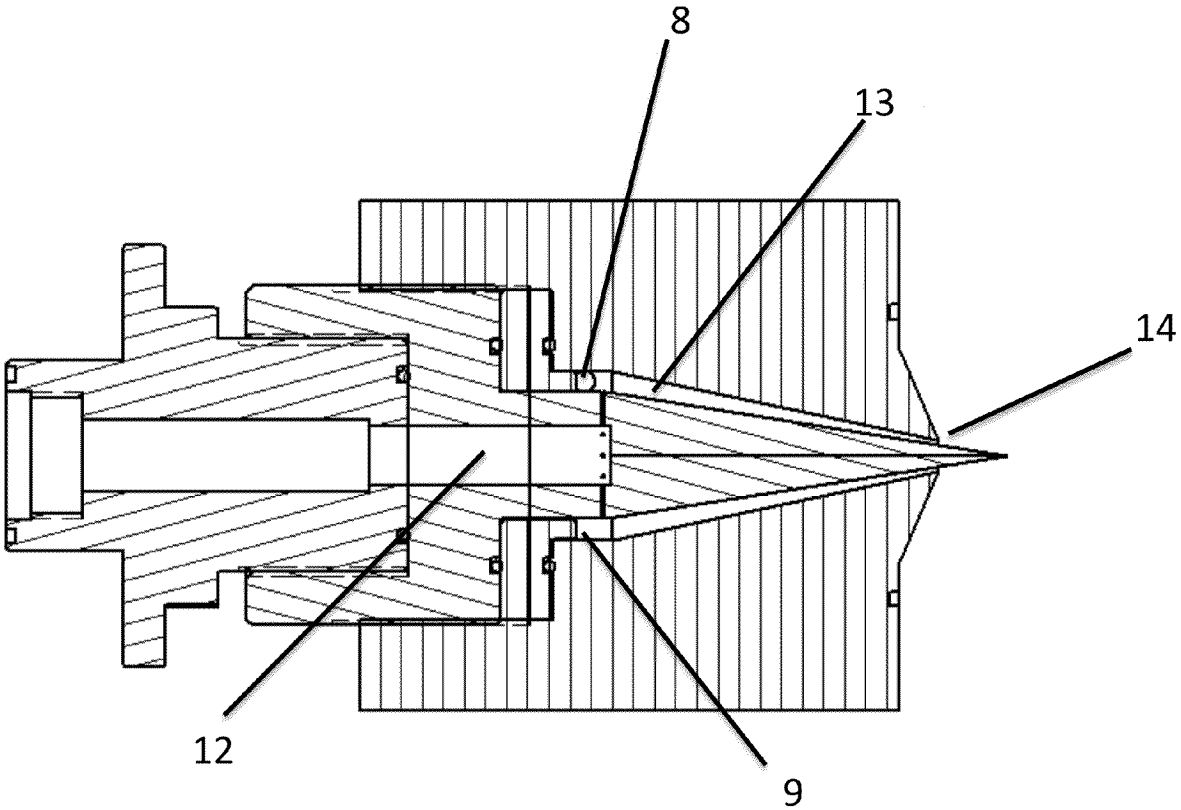
FIG. 5 is cross-sectional view of a two-phase flow nozzle according to the disclosure.
Figure 6:
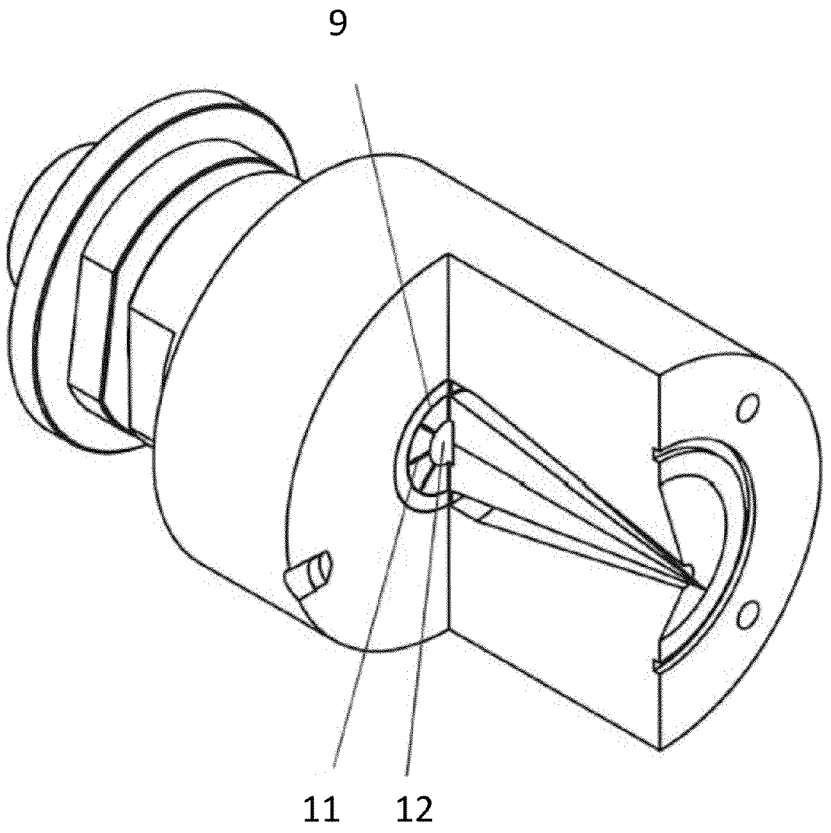
FIG. 6 is a cut-out perspective view of a converging channel according to the disclosure.
Figure 7:
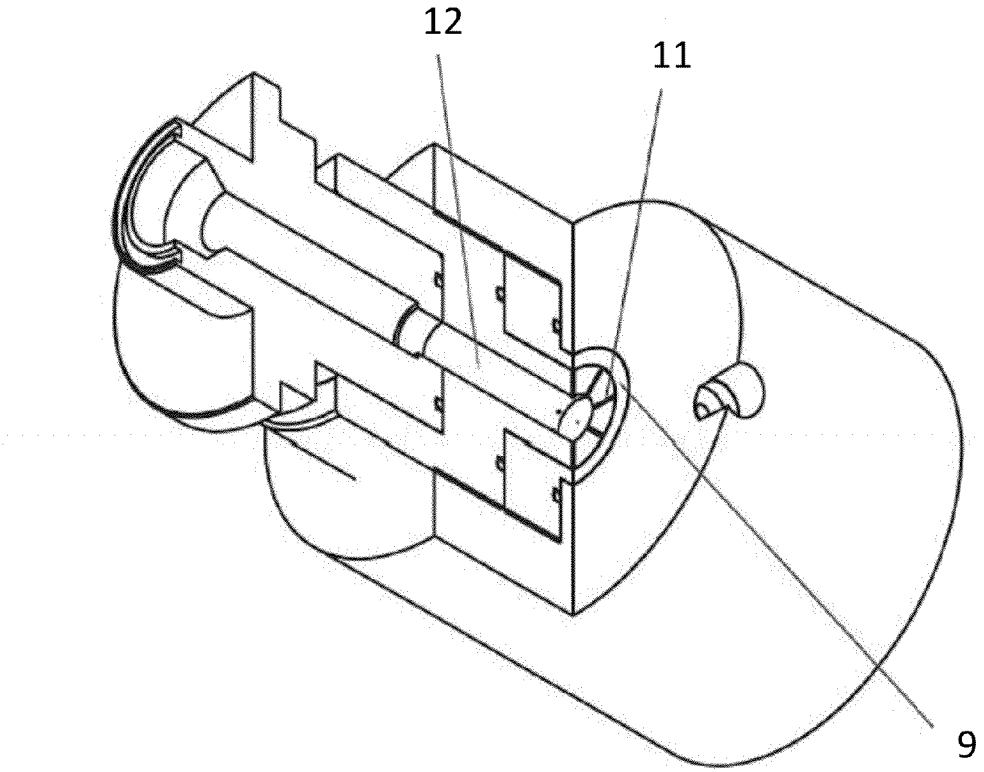
FIG. 7 is a cut-out perspective view of a polymer feeding tube according to the disclosure.
Figure 8:
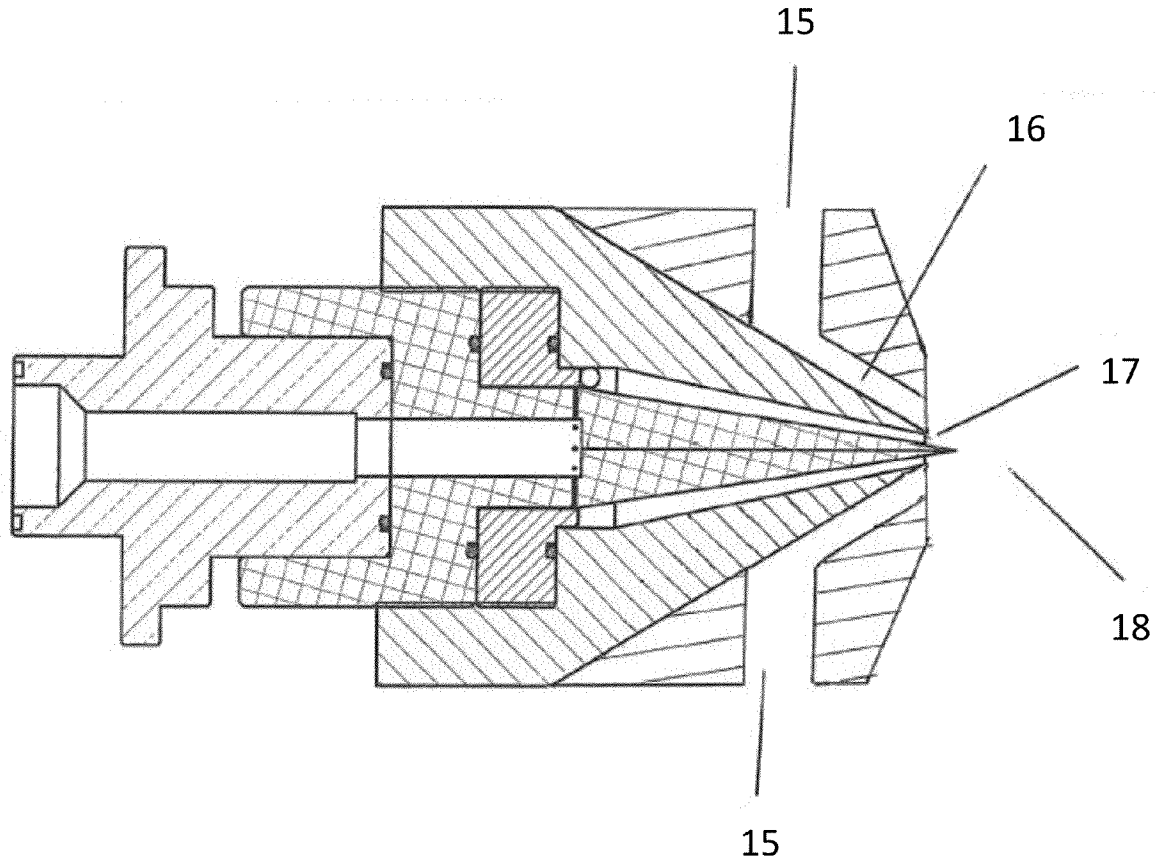
FIG. 8 is cross-section view of a two-phase flow nozzle according to the disclosure with a particle loading option.

A process for spinning polymer submicron fibers into non-woven webs without the use of solvents according to the present disclosure is shown in FIG. 1 and consists of the following process steps: The two-phase method for spinning polymeric fibers without the use of solvents is shown in FIG. 1 and consisted of the following process steps: polymer was heated and stirred in a reactor vessel 1 to the desired spinning temperature (the polymer temperature). The stirrer 2 was stopped and ambient air was fed through a pressurization line 3 to establish a head pressure 4 on the melted polymer (the polymer pressure). The valve 5 was opened and pressurized polymer was forced out of the reactor vessel 1 through the valve 5 and then through a filter 6 and into the nozzle 7. Heated, pressurized air was injected through ports 8 (see FIG. 2, FIG. 3, FIG. 4, and FIG. 5) into the mixing chamber 9 of the two phase flow nozzle creating a rotational flow 10 (see FIG. 4). Heated polymer was injected into the two-phase chamber 9 through eight orifices 11 (see FIG. 6, FIG. 7) spaced at 45 degree locations around a cylindrical polymer feed tube 12. The two-phasing air flow mixed with the polymer creating a two-phase flow which was then forced through a converging channel 13. The decreasing area of the converging channel 13 forced an increase in air speed along the axis of the nozzle and transitioned the rotational flow in the two-phase chamber into a mainly axial flow as it exited the nozzle through the annular orifice 14. It is believed that: the polymer is sheared by the accelerating gas flow within the converging channel creating polymeric film layers on both sides of the converging channel 13. These polymeric film layers were sheared into fibers by the accelerated gas flow such that resulting fiber fineness corresponded to the thickness of the polymeric film. One aspect of the process is that the total volumetric polymer flow can be easily regulated by the number of polymer injection orifices 11, thus creating a way to vary film thickness at the exit annular orifice 14 and hence fiber size. Heated air carrying powder(s) was injected 15 (see FIG. 8) into the two-phase nozzle and forced into an annulus 16 such that this flow impinged upon and into 17 the two-phase flow of polymer and heated air while the polymer was still above its melt temperature. The combined flows then mixed and the powder(s) became attached to the fibers. In a preferred embodiment, the fibers are collected on a screen at a distance of approximately 12-28 in from the exit of the two-phase nozzle.

In an alternate embodiment of the process, the solidified issued material is collected at a set distance from the exit of the two-phase nozzle, also referred to herein as the "collection surface". The collector can be a stationary flat porous structure made from perforated metal sheet or rigid polymer. The collector can be coated with a friction-reducing coating such as a fluoropolymer resin, or it can be caused to vibrate in order to reduce the friction or drag between the collected material and the collection surface. The collection surface is preferably porous so that vacuum can be applied to the material as it is being collected to assist the pinning of the material to the collector. In one embodiment, the collection surface comprises a honeycomb material, which allows vacuum to be pulled on the collected material through the honeycomb material while providing sufficient rigidity not to deform as a result. The honeycomb can further have a layer of mesh covering it to collect the issued material.

The collection surface can also be a component of the desired product itself. For instance, a preformed sheet can be the collection surface and a thin layer can be issued onto the collection surface to form a thin membrane on the surface of the preformed sheet. This can be useful for enhancing the surface properties of the sheet, such as printability, adhesion, porosity level, and so on. The preformed sheet can be a nonwoven or woven sheet, or a film. In this embodiment, the preformed sheet can even be a nonwoven sheet formed in the process of the disclosure itself, and subsequently fed through the process of the disclosure a second time, supported by the collection belt, as the collection surface. In another embodiment of the present disclosure, a preformed sheet can even be used in the process of the disclosure as the collection belt itself.

The collection surface can alternatively comprise a flexible collection belt moving over a stationary cylindrical porous structure. The collection belt is preferably a smooth, porous material so that vacuum can be applied to the collected material through the cylindrical porous structure without causing holes to be formed in the collected material.

The collection surface can alternatively further comprise a substrate such as a woven or a nonwoven fabric moving on the moving collection belt, such that the issued material is collected on the substrate rather than directly on the belt. This is especially useful when the material being collected is in the form of very fine particles.

In one embodiment of the disclosure in which the material being issued comprises a polymeric fibrous material, the material collected on the collection surface is heated sufficiently to bond the material. This can be accomplished by maintaining the temperature of the atmosphere surrounding the collected material at a temperature sufficient to bond the collected material. The temperature of the material can be sufficient to cause a portion of the polymeric fibrous material to soften or become tacky so that it bonds to itself and the surrounding material as it is collected. A small portion of the polymer can be caused to soften or become tacky either by heating the issued material before it is collected sufficiently to melt a portion thereof, or by collecting the material and immediately thereafter, melting a portion of the collected material by way of the heated gas passing therethrough. In this way, the process of the disclosure can be used to make a self-bonded nonwoven product, wherein the temperature of the gas passing through the collected material is sufficient to melt or soften a small portion of the web but not so high as to melt a major portion of the web.

Various methods can be employed to secure or pin the material to the collection surface. According to one method, vacuum is applied to the collection surface from the side opposite the collection surface at a sufficient level to cause the material to be pinned to the collection surface.

As an alternative to pinning the material by vacuum, the material can also be pinned to the collection surface by electrostatic force of attraction between the material and the collection surface, the collecting cylindrical structure, or the collection belt, as the case can be for a particular embodiment of the disclosure. This can be accomplished by creating either positive or negative ions in the gap between the nozzle and the collection surface while grounding the collection surface, so that the newly issued material picks up charged ions and thus the material becomes attracted to the collection surface. Whether to create positive or negative ions in the gap between the nozzle and the collector is determined by what is found to more efficiently pin the material being issued. It has surprisingly been found that the uniformity index of the produced material improves with the application an electrical charge.

In order to create positive or negative ions in the gap between the nozzle and the collection surface, and thus to positively or negatively charge the solidified issued material passing through the gap, one embodiment of the process of the present disclosure employs a charge-inducing element installed on the nozzle. The charge-inducing element can comprise pin(s), brushes, wire(s) or other element, wherein the element is made from a conductive material such as metal or a synthetic polymer impregnated with carbon. A voltage is applied to the charge-inducing element such that an electric current is generated in the charge-inducing element, creating a strong electric field in the vicinity of the charge-inducing element which ionizes the gas in the vicinity of the element thereby creating a corona. The amount of electrical current necessary to be generated in the charge-inducing element will vary depending on the specific material being processed, but the minimum is the level found to be necessary to sufficiently pin the material, and the maximum is the level just below the level at which arcing is observed between the charge-inducing element and the grounded collection belt.

EXAMPLES

All documents cited are, in relevant part, incorporated herein by reference; the citation of any document is not to be construed as an admission that it is prior art with respect to the present disclosure.

Method Used to Determine Fiber Size Distributions

A scanning electron microscope (SEM) was used to take micrographs of polymer fibers. Various magnifications were used and a scale watermark of 5, 10, 20, or 100 microns was overlaid onto the SEM image accordingly. The SEM picture was imported into PowerPoint®, and an x and y axis was placed onto the picture and related to the micron scale using the line drawing tool. The resulting image was captured and imported into Digitizelt© (a software program used to digitize points within an image). Lengths (in microns) of the pictured axes were reported to the program relative to the micron scale overlaid onto the SEM image, and two (x,y) data point.

Method Used to Determine the Machine Direction Uniformity Index. The MD UI of a sheet is calculated according to the following procedure. A beta thickness and basis weight gauge (Quadrapac Sensor by Measurex Infrand Optics) scans the sheet and takes a basis weight measurement every 0.2 inches (0.5 cm) across the sheet in the cross direction (CD). The sheet then advances 0.42 inches (1.1 cm) in the machine direction (MD) and the gauge takes another row of basis weight measurements in the CD. In this way, the entire sheet is scanned, and the basis weight data is electronically stored in a tabular format. The rows and columns of the basis weight measurements in the table correspond to CD and MD "lanes" of basis weight measurements, respectively. Then each data point in column 1 is averaged with its adjacent data point in column 2; each data point in column 3 is averaged with its adjacent data point in column 4; and so on. Effectively, this cuts the number of MD lanes (columns) in half and simulates a spacing of 0.4 inch (1 cm) between MD lanes instead of 0.2 inch (0.5 cm). In order to calculate the uniformity index (UI) in the machine direction ("MD UI"), the UI is calculated for each column of the averaged data in the MD. The UI for each column of data is calculated by first calculating the standard deviation of the basis weight and the mean basis weight for that column. The UI for the column is equal to the standard deviation of the basis weight divided by the square root of the mean basis weight, multiplied by 100. Finally, to calculate the overall machine direction uniformity index (MD UI) of the sheet, all of the UI's of each column are averaged to give one uniformity index. The units for uniformity index are (ounces per square yd)½.

Example 1

Figure 9:
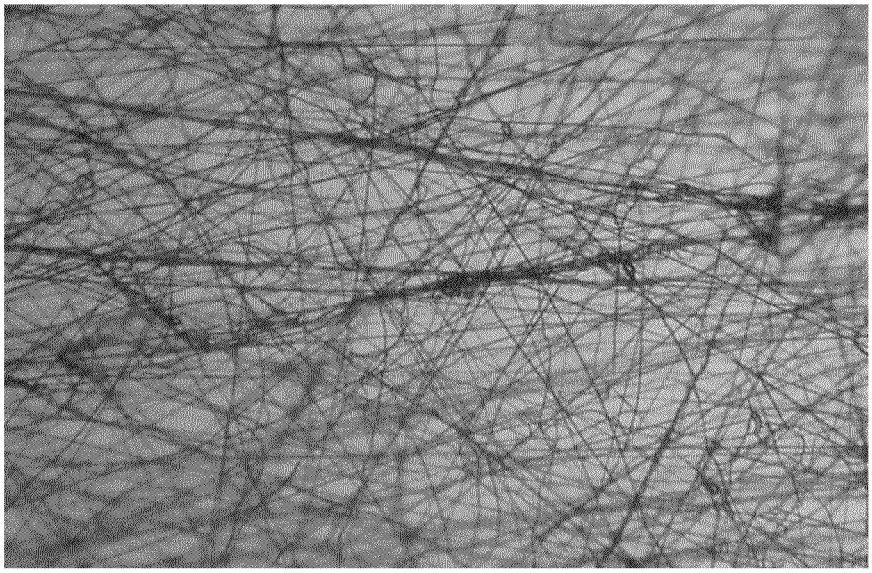
FIG. 9 is a microscope picture of fibers produced according to example 1 of the disclosure.
Figure 10:
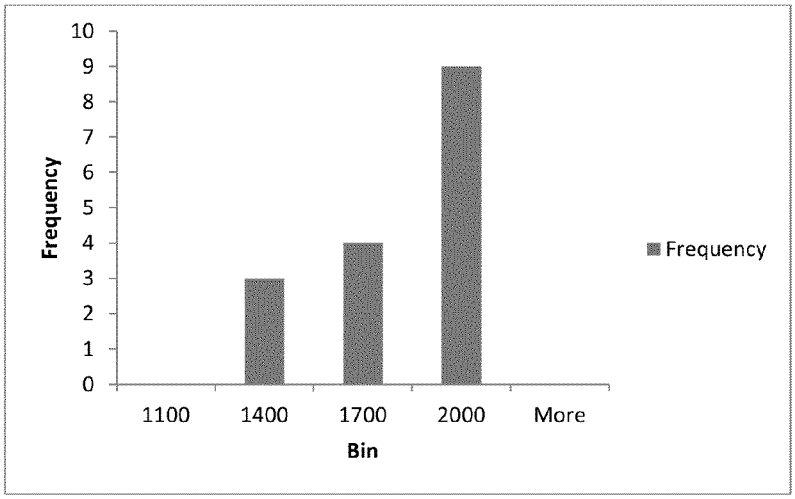
FIG. 10 is the fiber size distribution corresponding to FIG. 9.

A stainless steel reactor vessel (volume=0.5 l) was charged with 70 g of Capa 6100 polycaprolactone polymer (Perstorp) and 30 g of Capa 6500 polycaprolactone polymer (Perstorp). The polymer mixture was heated to 140 C and pressurized to 25 psig. The heated and pressurized polymer was forced through a 140 micron rated filter and then into the two-phase nozzle. Heated air was injected into the two-phase chamber at 171 C and 40 psig. Fibers were produced at a rate of 0.014 g/min. A microscope picture of the fibers produced is shown in FIG. 9. The fiber size distribution is shown in FIG. 10.

Example 2

Figure 11:
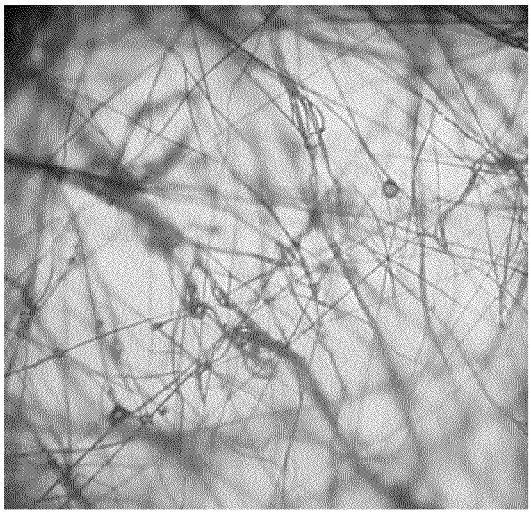
FIG. 11 is a microscope picture of fibers produced according to example 2 of the disclosure.
Figure 12:
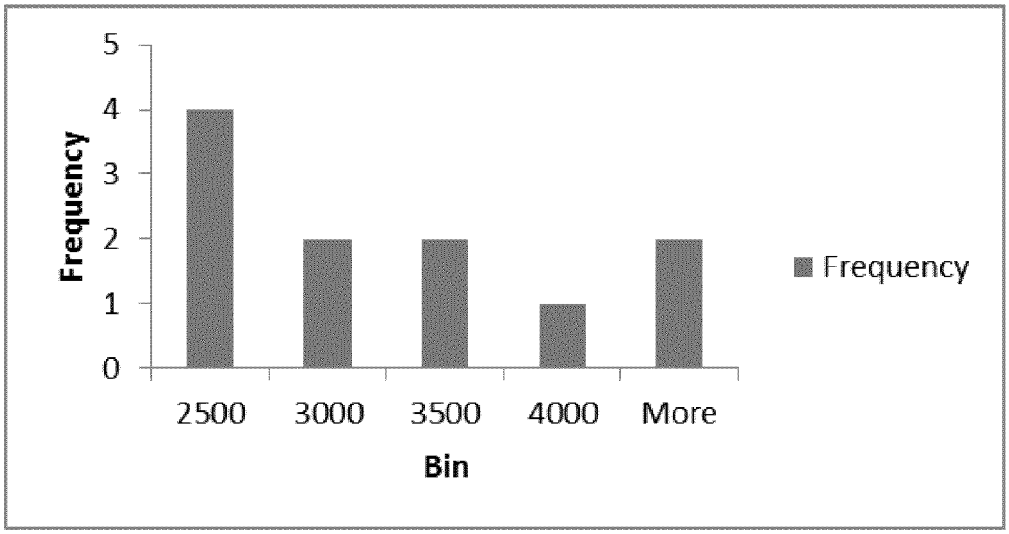
FIG. 12 is the fiber size distribution corresponding to FIG. 11.

A stainless steel reactor vessel (volume=0.5 l) was charged with 70 g of Capa 6100 polycaprolactone polymer (Perstorp) and 30 g of Capa 6500 polycaprolactone polymer (Perstorp). The polymer mixture was heated to 160 C and pressurized to 40 psig. The heated and pressurized polymer was forced through a 140 micron rated filter and then into the two-phase nozzle. Heated air was injected into the two-phase chamber at 181 C and 60 psig. Fibers were produced at a rate of 0.31 g/min. A microscope picture of the fibers produced is shown in FIG. 11. The fiber size distribution is shown in FIG. 12.

Example 3

Figure 13:
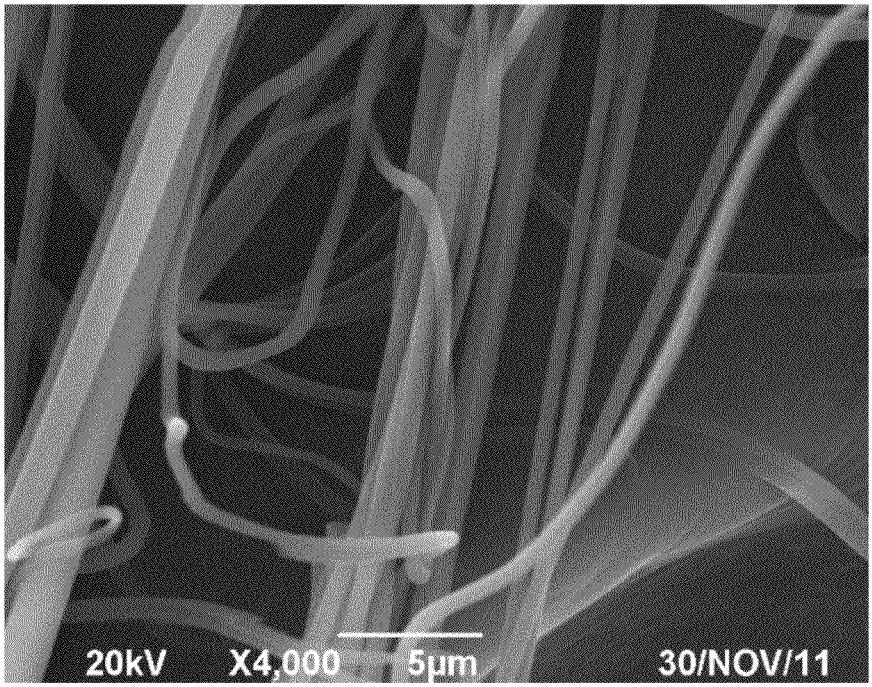
FIG. 13 is a microscope picture of fibers produced according to example 3 of the disclosure.
Figure 14:
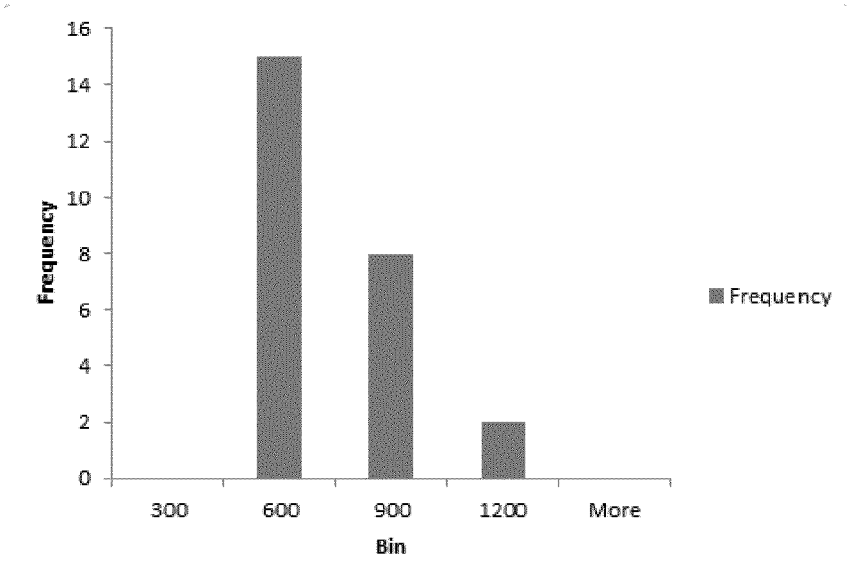
FIG. 14 is the fiber size distribution corresponding to FIG. 13.

A stainless steel reactor vessel (volume=0.5 l) was charged with 70 g of Capa 6100 polycaprolactone polymer (Perstorp) and 30 g of Capa 6500 polycaprolactone polymer (Perstorp). The polymer mixture was heated to 156 C and pressurized to 40 psig. The heated and pressurized polymer was forced through a 140 micron rated filter and then into the two-phase nozzle. Heated air was injected into the two-phase chamber at 225 C and 60 psig. Fibers were produced at a rate of 0.014 g/min. A SEM of the fibers produced is shown in FIG. 13. The fiber size distribution is shown in FIG. 14.

Example 4

Kaolin

Figure 15:
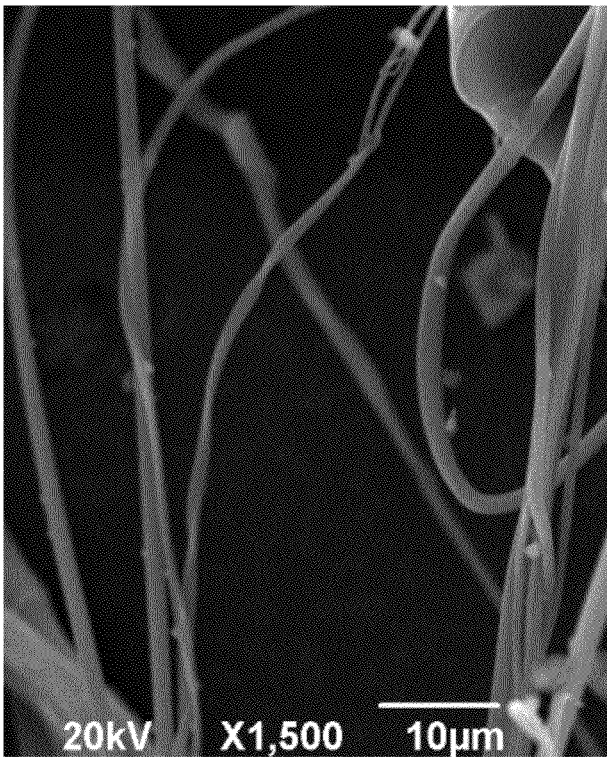
FIG. 15 is an SEM picture of fibers produced in Example 4.

A stainless steel reactor vessel (volume=0.5 l) was charged with 100 g of Capa 6100 polycaprolactone polymer (Perstorp), 30 g of Capa 6500 polycaprolactone polymer (Perstorp), 5 g of Capa 6800 (Perstop), and 0.5 g of Cocamidopropyl Betaine. The mixture was heated to 158 C and pressurized to 38 psig to make example 4-1 and the mixture was heated to 155 C and pressurized to 38 psig to make example 4-2. The heated and pressurized mixture was forced through a 140 micron rated filter and then into the two-phase nozzle. Heated air was injected into the two-phase chamber at 238 C and 40 psig for example 4-1 and heated air was injected into the two-phase chamber at 240 C and 40 psig for example 4-2. A SEM of example 4-1 as spun is shown in FIG. 15. A flow of air and Kaolin powder at 81 C was impinged upon the primary two-phase flow, thereby attaching powder to the polymer mixture melt for example 4-1; and a flow of air and Kaolin powder at 120 C impinged upon the primary two-phase flow, thereby attaching powder to the polymer mixture melt for example 4-2. The production rates where: 0.77 g/min for example 4-1 and 0.81 g/min for example 4-2. The samples as-spun were water washed in stirred beaker to induce some shear on the attached powder. The samples were then "ashed" to determine the amount of powder remaining on the samples.

TABLE 1

| Fibers As-spun | | |
|---|---|---|
| | Water washed | Weight % Kaolin on fibers (average of 4 samples) |
| Example 4-1 | no | 3.4 |
| | Yes | 1.3 |
| Example 4-2 | no | 6.9 |
| | Yes | 0.9 |

Another set of the samples were heated in an oven to 55 C for 10 minutes and then subjected to water washing and "ashed" to determine the remaining amounts of powder.

TABLE 2

| Fibers Post-spun Heated | | |
|---|---|---|
| | Water washed | Weight % Kaolin on fibers (average of 4 samples) |
| Example 4-1 | no | 3.4 |
| | Yes | 1.3 |
| Example 4-2 | no | 6.9 |
| | Yes | 2.7 |

Another set of samples were tested for blood clotting time. For reference, the control clotting time was 7.5 minutes, whereby the blood was brought to body temperature and allowed to clot without clotting agents present.

TABLE 3

| | Air washed | Weight % Kaolin Lost | Clotting time (min) |
|---|---|---|---|
| Example 4-1 | no | | 1.8 |
| | Yes | 17.6 | 1.5 |
| Example 4-2 | no | | 1.3 |
| Post heated | Yes | 6.3 | 1.7 |

Example 5

Chitosan

Figure 16:
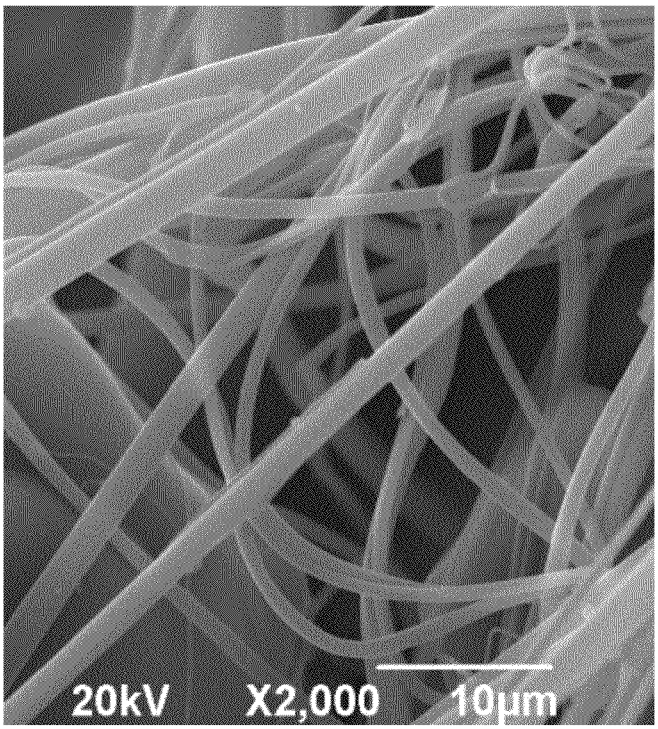
FIG. 16 is an SEM picture of fibers produced in Example 5.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 157 C and pressurized to 38 psig. The heated and pressurized mixture was forced through a 140 micron rated filter and then into the two-phase flow nozzle. Heated air was injected into the two-phase chamber at 220 C and 38 psig. A flow of air and chitosan powder at 105 C impinged upon the primary two-phase flow, thereby attaching the powder to the polymer mixture melt. A SEM of the fibers produced is shown in FIG. 16. The production rate was 1.72 g/min. The amount of attached chitosan powder was 10.1% by weight. The blood clotting time was measured to be 4.5 minutes. An observation was that chitosan absorbed the blood very well and created a gel although the time to clot was lengthy.

Example 6

Chitosan and Kaolin

Figure 17:
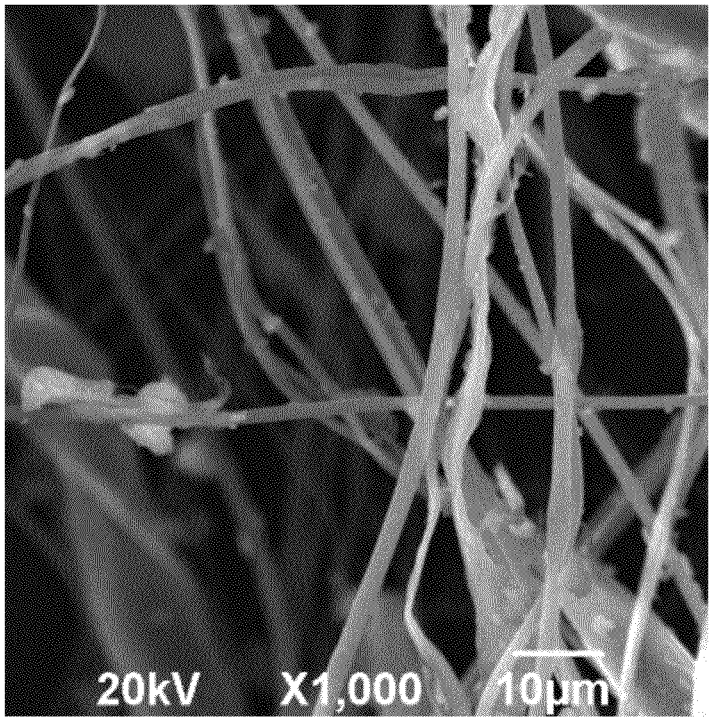
FIG. 17 is an SEM picture of fibers produced in Example 6.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 154 C and pressurized to 37-38 psig. The heated and pressurized mixture was forced through a 140 micron rated filter and then into the two-phase nozzle. Heated air was injected into the two-phase chamber at 218 C and 30-37 psig. A flow of air, chitosan powder, and kaolin powder at 76 C impinged upon the primary two-phase flow, thereby attaching the powders to the polymer mixture melt. The ratio of powders was: kaolin 75% and chitosan 25%. A SEM of the collected fibers is shown in FIG. 17. The production rate was 0.7-0.88 g/min. The amount of attached powder (chitosan and kaolin) was 17% by weight; chitosan at 14.5% and kaolin at 2.5%. The sample was water washed and amount of attached kaolin after washing was 0.9% and the amount of attached chitosan was found to be approximately unchanged at 14.5%.

TABLE 4

| Air washed | Powder Weight % Lost | Clotting time (min) |
|---|---|---|
| no | 1.8 | |
| Yes | 3.4 | 1.5 |

Air washing was observed to create a more "open" structure, thereby permitting the blood to flow more freely into the fibrous structure. Also, it was observed that the blood began clotting immediately and wetted out the sample due to the chitosan.

Example 7

⅓ Mol Calcium Peroxide and ⅔ Mol Citric Acid

Figure 18:
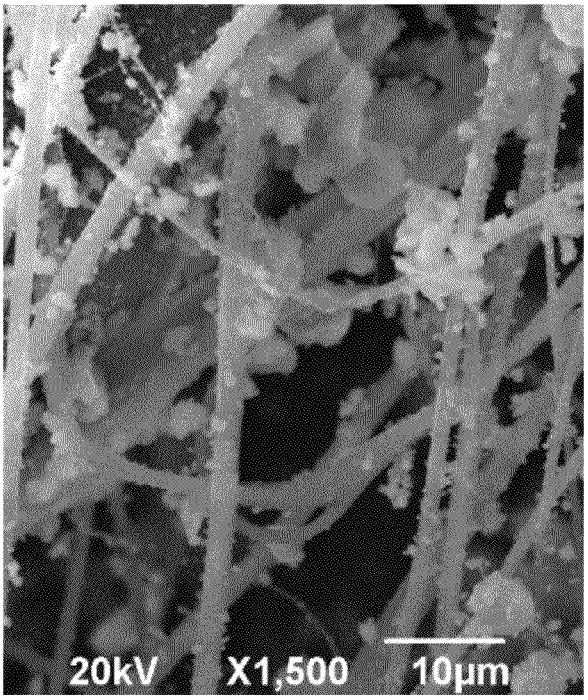
FIG. 18 is an SEM picture of fibers produced in Example 7.
Figure 19:
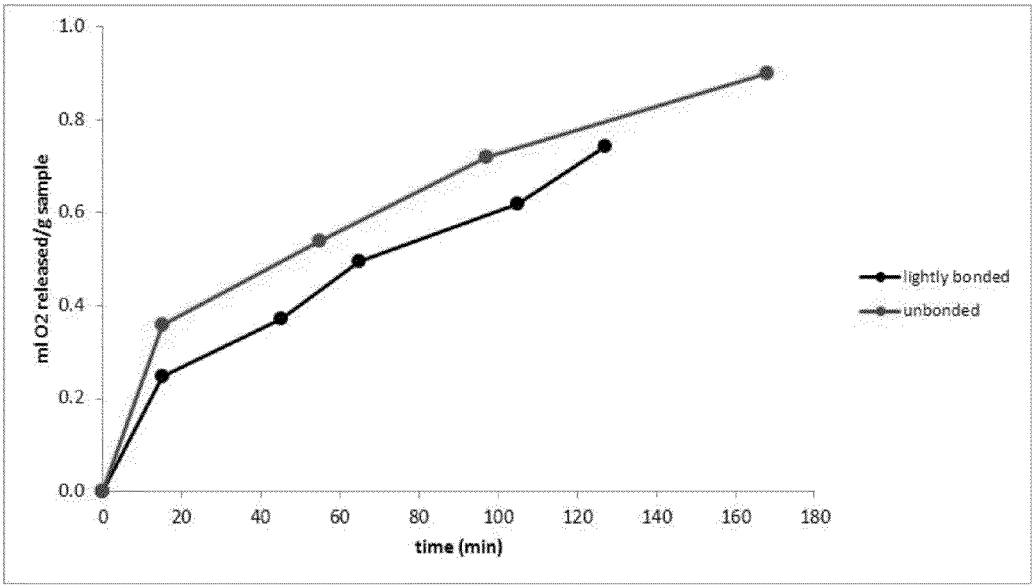
FIG. 19 shows the release of oxygen corresponding to Example 7.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 154 C and pressurized to 40 psig. The heated and pressurized polymer was forced through a 140 micron rated filter and then into the two-phase nozzle. Heated air was injected into the two-phase chamber at 228 C and 40 psig. A flow of air, ⅓ mol calcium peroxide powder, and ⅔ mol citric acid powder at 60 C was impinged upon the primary two-phase flow, thereby attaching the powders to the polymer mixture melt. The production rate was 0.71 g/min. The attachment of the powders to the fibers is shown in FIG. 18. The sample was saturated with water and the release rate of oxygen was measured (see FIG. 19.)

Example 8

Copper Oxide, Chitosan, and Reon

Figure 20:
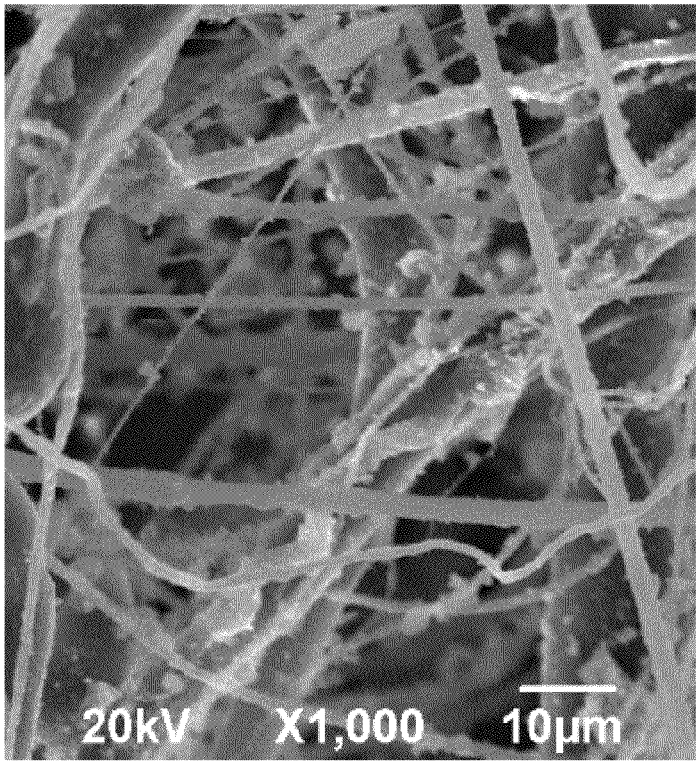
FIG. 20 is an SEM picture of fibers produced in Example 8.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 152 C and pressurized to 40 psig. The heated and pressurized polymer was forced through a 140 micron rated filter and then into the two-phase nozzle. Heated air was injected into the two-phase chamber at 212 C and 38 psig. A flow of air, Reon powder, copper oxide powder, and chitosan powder at 350 C was impinged upon the primary two-phase flow, thereby attaching the powders to the polymer mixture melt. The weight ratio of the powders was: Reon 25%, copper oxide 25%, and chitosan 50%. A SEM picture of the collected fibers is shown in FIG. 20. The production rate was 0.6 g/min.

Example 9

⅓ Mol Calcium Peroxide and ⅔ Mol Citric Acid; and Chitosan

Figure 21:
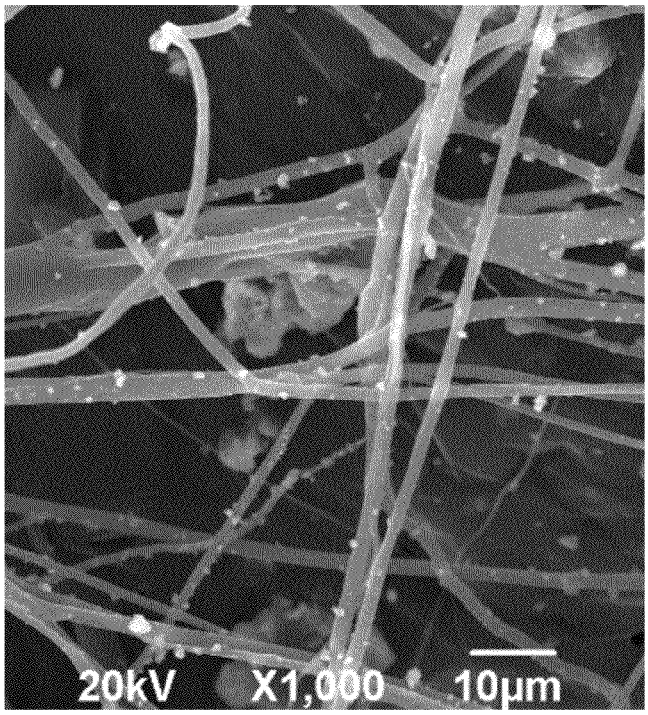
FIG. 21 is an SEM picture of fibers produced in Example 9.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 154 C and pressurized to 40 psig. The heated and pressurized polymer was forced through a 140 micron rated filter and then into the two-phase flow nozzle. Heated air was injected into the two-phase chamber at 228 C and 40 psig. A flow of air, ⅓ mol calcium peroxide powder, ⅔ mol citric acid powder, and chitosan powder at 60 C was impinged upon the primary two-phase flow, thereby attaching the powders to the polymer mixture melt. The weight ratio of the powders was: citric acid 51%, calcium peroxide 19%, and chitosan 25%. A SEM picture of the collected fibers is shown in FIG. 21. The production rate was 0.71 g/min.

Example 10

Kaolin, Chitosan, and Reon Vacuum Steamed

Figure 22:
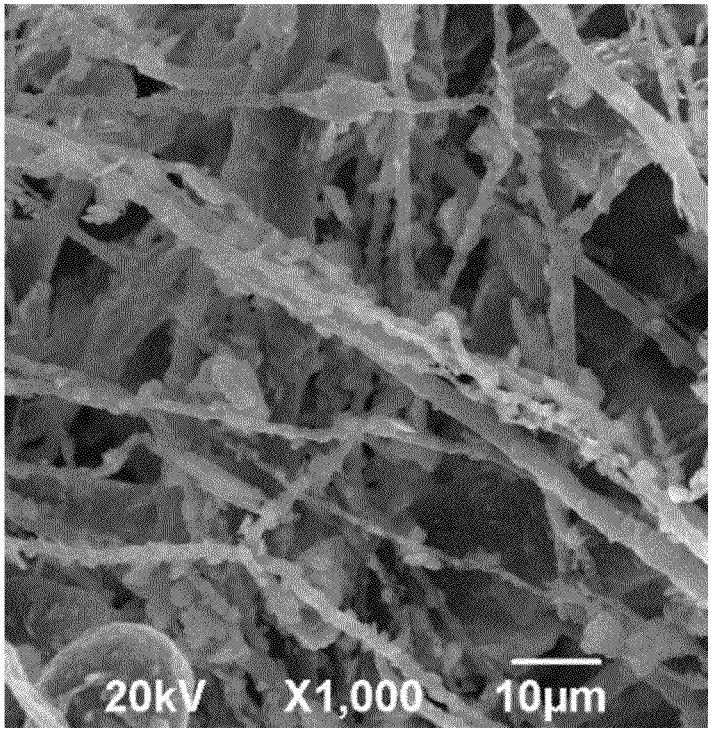
FIG. 22 is an SEM picture of fibers produced in Example 10.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 152 C and pressurized to 40 psig. The heated and pressurized polymer was forced through a 140 micron rated filter and then into the two-phase flow nozzle. Heated air was injected into the two-phase chamber at 212 C and 38 psig. A flow of air, Reon powder, kaolin powder, and chitosan powder at 350 C impinged upon the primary two-phase flow, thereby attaching the powders to the polymer mixture melt. The weight ratio of the powders was: Reon 40%, kaolin 50%, and chitosan 10%. The production rate was 0.6 g/min. After the sample was formed, a flow of steam was vacuumed through the material. This technique made the reon powder sticky thus forming more of a bond between the powders and the fibers. A SEM picture of the material is shown in FIG. 22.

Example 11

Kaolin, Chitosan, and Reon

Figure 23:
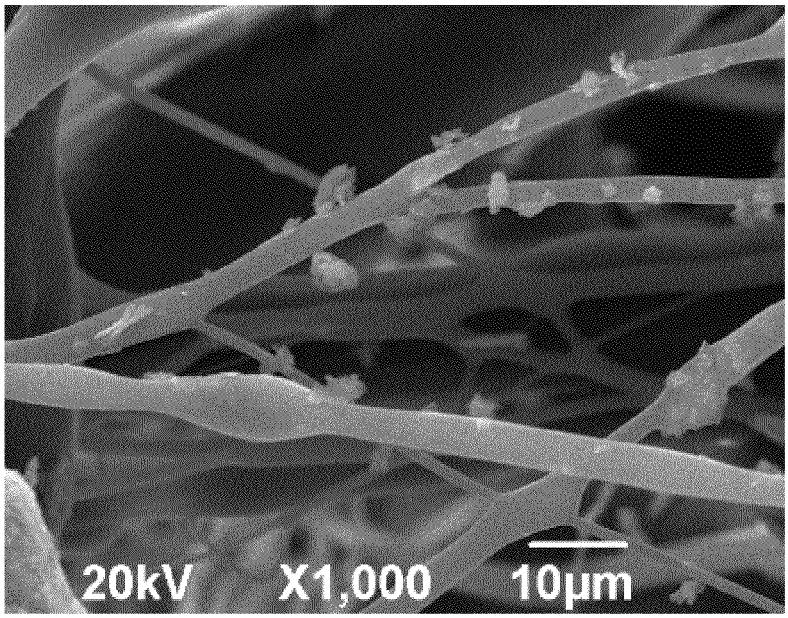
FIG. 23 is an SEM picture of fibers produced in Example 11.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 152 C and pressurized to 40 psig. The heated and pressurized polymer was forced through a 140 micron rated filter and then into the two-phase nozzle. Heated air was injected into the two-phase chamber at 212 C and 38 psig. A flow of air, Reon powder, kaolin powder, and chitosan powder at 350 C was impinged upon the primary two-phase flow, thereby attaching the powders to the polymer mixture melt. The weight ratio of the powders was: Reon 25%, copper oxide 25%, and chitosan 50%. A SEM picture of the collected fibers is shown in FIG. 23. The production rate was 0.6 g/min.

Example 12

Kaolin

Figure 24:
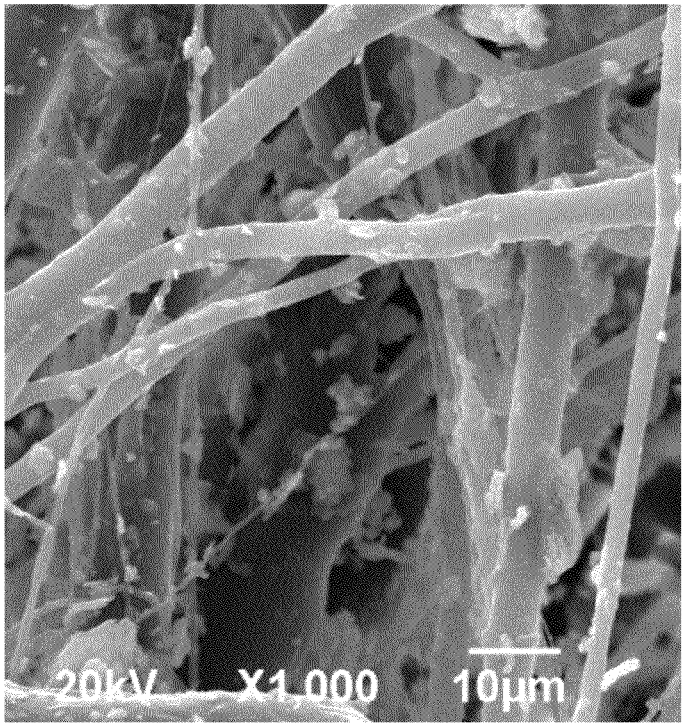
FIG. 24 is an SEM picture of fibers produced in Example 12.

A stainless steel reactor vessel (volume=0.5 l) was charged with 100 g of Capa 6100 polycaprolactone polymer (Perstorp), 30 g of Capa 6500 polycaprolactone polymer (Perstorp), 5 g of Capa 6800 (Perstop), and 0.5 g of Cocamidopropyl Betaine. The mixture was heated to 156 C and pressurized to 50 psig. The heated and pressurized mixture was forced through a 140 micron rated filter and then into the two-phase nozzle. Heated air was injected into the two-phase chamber at 197 C and 50 psig. A flow of heated air and Kaolin powder was impinged upon the primary two-phase flow, thereby attaching powder to the polymer mixture melt. A SEM picture of the collected fibers is shown in FIG. 24. The flowrate was 1.89 g/min.

Example 13

Figure 25:
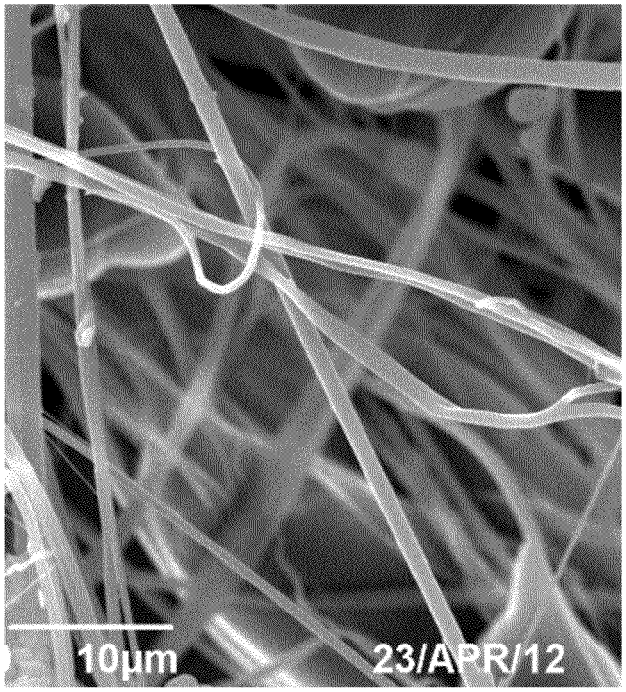
FIG. 25 is an SEM picture of fibers produced in Example 13.

A stainless steel reactor vessel (volume=0.5 l) was charged with 100 g of Capa 6100 polycaprolactone polymer (Perstorp), 30 g of Capa 6500 polycaprolactone polymer (Perstorp), 5 g of Capa 6800 (Perstop), and 0.5 g of Cocamidopropyl Betaine. The mixture was heated to 130 C and pressurized to 42 psig. The heated and pressurized mixture was forced through a 140 micron rated filter and then into the two-phase nozzle. Heated air was injected into the two-phase chamber at 207 C and 38 psig. Heated air was impinged onto the 2 phase flow at 400 C. A SEM picture of the collected fibers is shown in FIG. 25. The flowrate of fibers was 0.33 g/min.

Example 14

Figure 26:
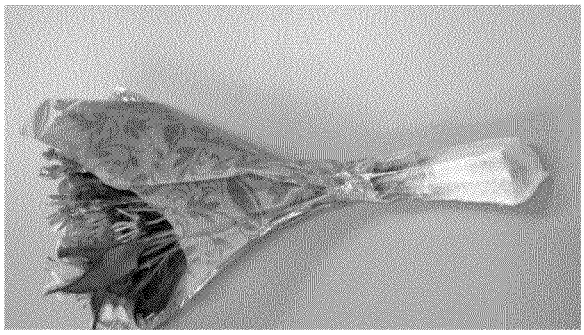
FIG. 26 is a photograph materials produced in Example 14.
Figure 27:
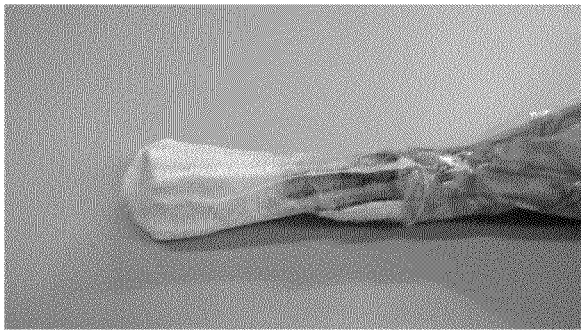
FIG. 27 is a photograph of materials produced in Example 14.
Figure 28:
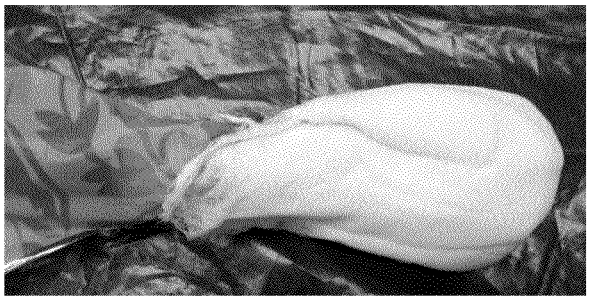
FIG. 28 is a photograph of materials produced in Example 14.

A stainless steel reactor vessel (volume=0.5 l) was charged with 50 g of NatureWorks® PLA polymer 6302D. The polymer was heated to 174 C and pressurized to 42 psig. The heated and pressurized polymer was forced through a 140 micron rated filter and then into the two-phase nozzle. Heated air was injected into the two-phase chamber at 278 C and 50 psig. A flow of heated air at approximately 350 C and powder mixture impinged upon the primary two-phase flow, thereby attaching the powder mixture to the polymer mixture melt. The powder mixture was 95% Reon™ and 2.5% Chrysal Clear Professional 2. The free jet carrying the PLA fibers and the attached Reon™ and Chrysal Clear Professional 2 powder mixture impinged upon the stems of a bouquet of cut flowers. The flowers were rotated slowly under the free jet allowing the fibers and attached powders to form a layer of material for transporting the bouquet. The material covered the cut ends of the stems and a distance of about 6 cm along the stems from the cut ends toward the flowers. The bouquet of flowers with the material is shown in FIGS. 26, 27, and 28.

Example 15

Tissue Scaffold

Figure 2:
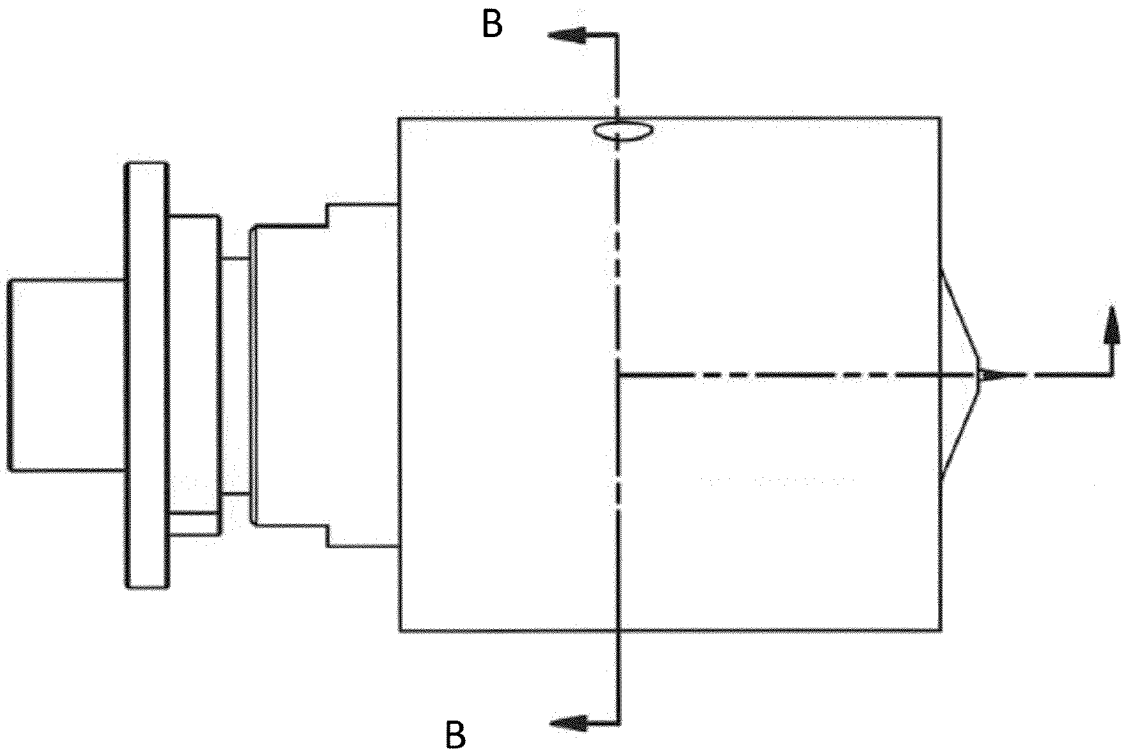
FIG. 2 is a sectional view of a two-phase flow nozzle according to the disclosure.
Figure 3:
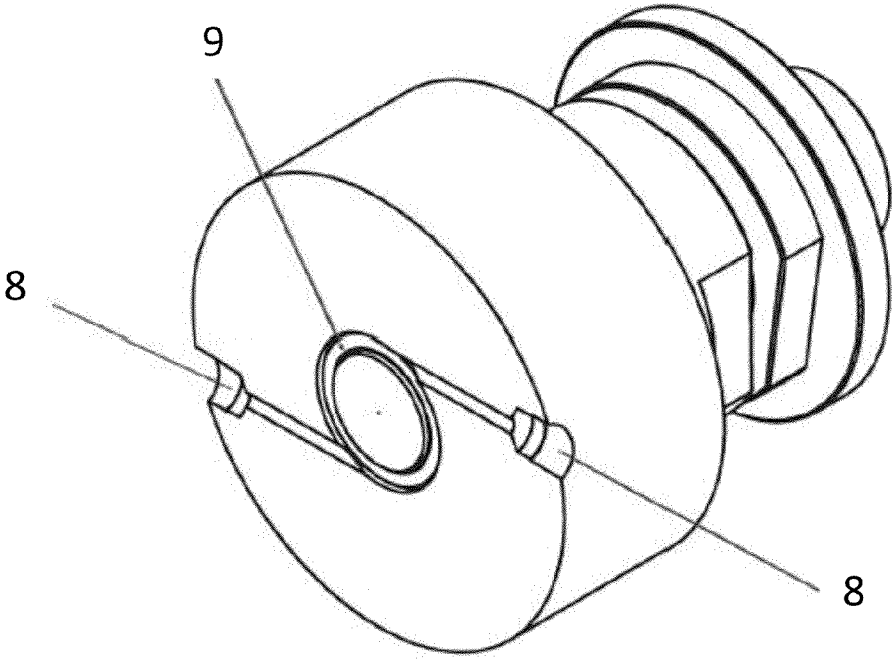
FIG. 3 is a perspective view of a two-phase flow nozzle according to the disclosure.
Figure 29:
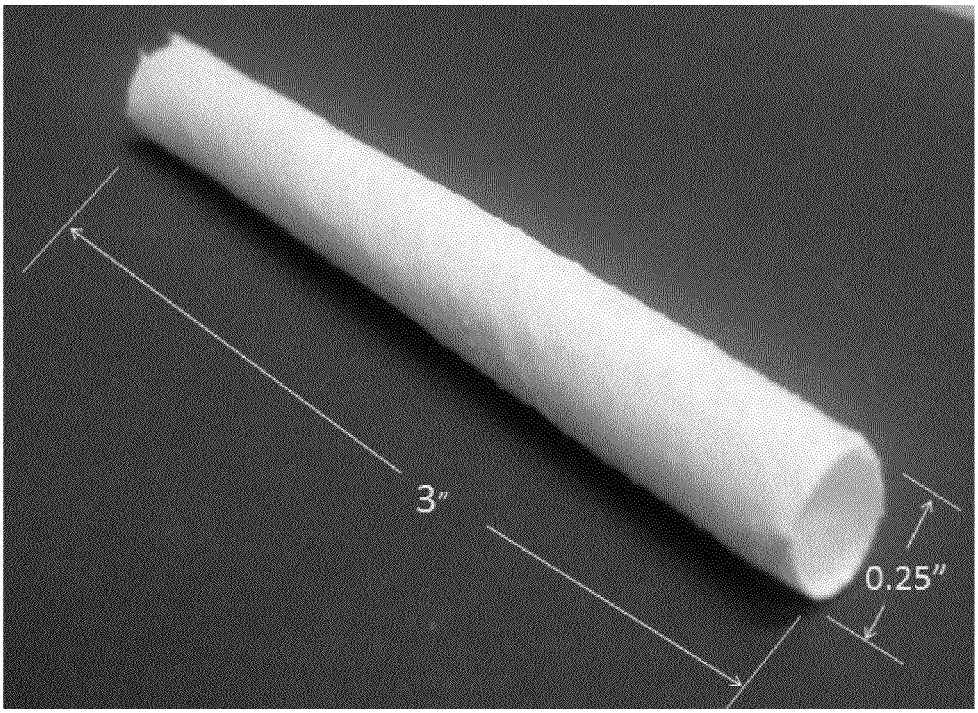
FIG. 29 is a tubular structure produced in Example 15.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 150 C and pressurized to 40 psig. The heated and pressurized mixture was forced through a 140 micron rated filter and then into the two-phase nozzle as shown in FIG. 2. Heated air was injected into the two-phase chamber at 210 C and 38 psig. Flowrate was 0.6 g/min. The issuing fibers were impinged upon a rotating circular plastic drinking straw at a distance of about 8 to 10 inches. The fibers were allowed to collect for about 4 to 4 minutes resulting in the formation of a tubular structure as shown in FIG. 29. The structure would be useful as a tissue engineering scaffold.

Example 16

A stainless steel reactor vessel (volume=0.5 l) was charged with 70 g of Capa 6100 polycaprolactone polymer (Perstorp), 30 g of Capa 6500 polycaprolactone polymer (Perstorp), 25 g of Natureworks polylatic acid polymer (PLA grade 6302D), and 2.5 g kaolin powder. The mixture was heated to 165 C and pressurized to 40 psig. The heated and pressurized mixture was forced through a 140 micron rated filter and then into the two-phase nozzle as shown in FIG. 2. Heated air was injected into the two-phase chamber at 265 C and 50 psig. The fibers produced were collected on a screen 12-28 inches away.

Example 17

A stainless steel reactor vessel (volume=0.5 l) was charged with 105 g of Capa 6100 polycaprolactone polymer (Perstorp), 37.5 g of Capa 6500 polycaprolactone polymer (Perstorp), 7.5 g of Capa 6800 polycaprolactone polymer (Perstorp), and 0.75 g of cocamidopropyl betaine. The mixture was heated to 150 C and pressurized to 50 psig. The heated and pressurized mixture was forced through a 140 micron rated filter and then into the two-phase nozzle as shown in FIG. 2. Heated air was injected into the two-phase chamber at 232 C and 52 psig. The fibers produced were collected on a screen 12-28 inches away.

Example 18

Figure 30:
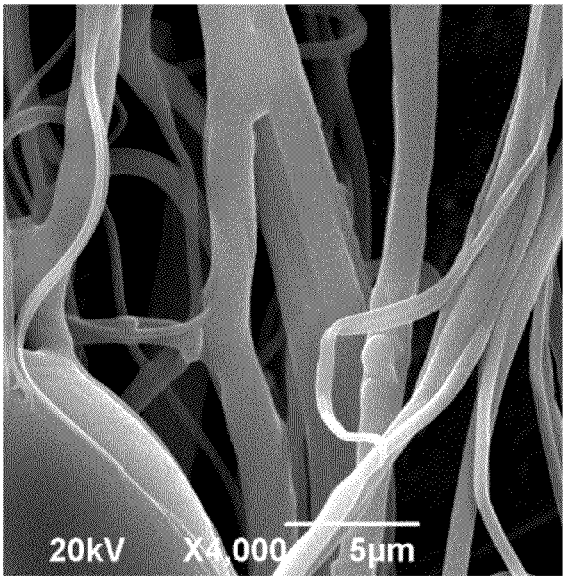
FIG. 30 is an SEM picture of fibers produced in Example 18.

A stainless steel reactor vessel (volume=0.5 l) was charged with 105 g of Capa 6100 polycaprolactone polymer (Perstorp), 37.5 g of Capa 6500 polycaprolactone polymer (Perstorp), 7.5 g of Capa 6800 polycaprolactone polymer (Perstorp), 0.75 g of cocamidopropyl betaine, and 1.5 g sodium percarbonate. The mixture was heated to 80 C and pressurized to 40 psig. The heated and pressurized mixture was forced through a 140 micron rated filter and then into the two-phase nozzle as shown in FIG. 2. Heated air was injected into the two-phase chamber at 240 C and 50 psig. The fibers produced were collected on a screen 12-28 inches away. A SEM picture of the fibers collected is shown in FIG. 30.

Example 19

Figure 31:
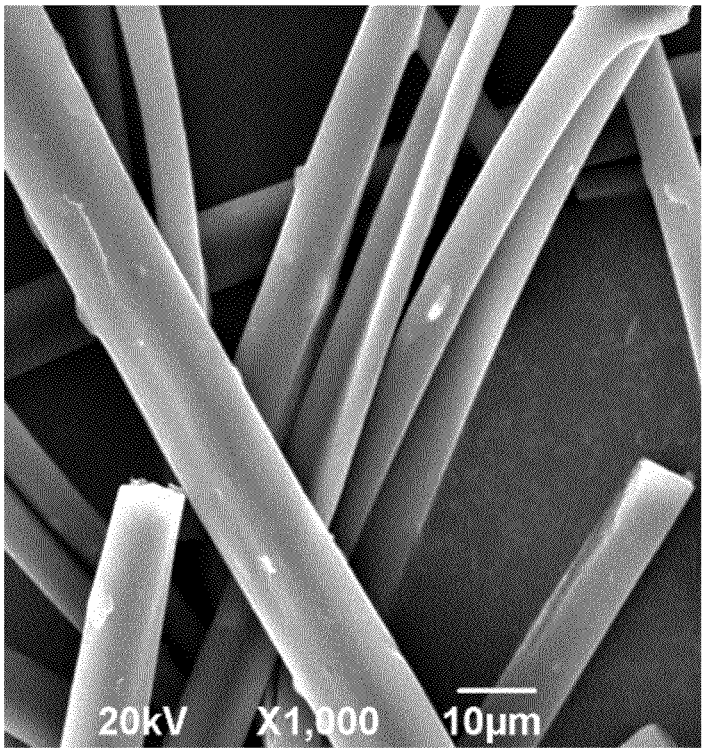
FIG. 31 is an SEM picture of fibers produced in Example 19.

A stainless steel reactor vessel (volume=0.5 l) was charged with 25 g of Capa 6100 polycaprolactone polymer (Perstorp), 25 g poly (2-ethyl 2 oxazoline) polymer, and 2.75 g kaolin powder. The mixture was heated to 154 C and pressurized to 32 psig. The heated and pressurized mixture was forced through a 140 micron rated filter and then into the two-phase nozzle as shown in FIG. 2. Heated air was injected into the two-phase chamber at 243 C and 40 psig. The fibers produced were collected on a screen 12-28 inches away. A SEM picture of the fibers collected is shown in FIG. 31.

Example 20

A stainless steel reactor vessel (volume=0.5 l) was charged with 25 g of Capa 6100 polycaprolactone polymer (Perstorp), 27.3 g of Capa 6500 polycaprolactone polymer (Perstorp), 10 g poly (2-ethyl 2 oxazoline) polymer, and 5 g water. The mixture was heated to 151 C and pressurized to 32 psig. The heated and pressurized mixture was forced through a 140 micron rated filter and then into the two-phase nozzle as shown in FIG. 2. Heated air was injected into the two-phase chamber at 222 C and 40 psig. The fibers produced were collected on a screen 12-28 inches away.

Example 21

Figure 32:
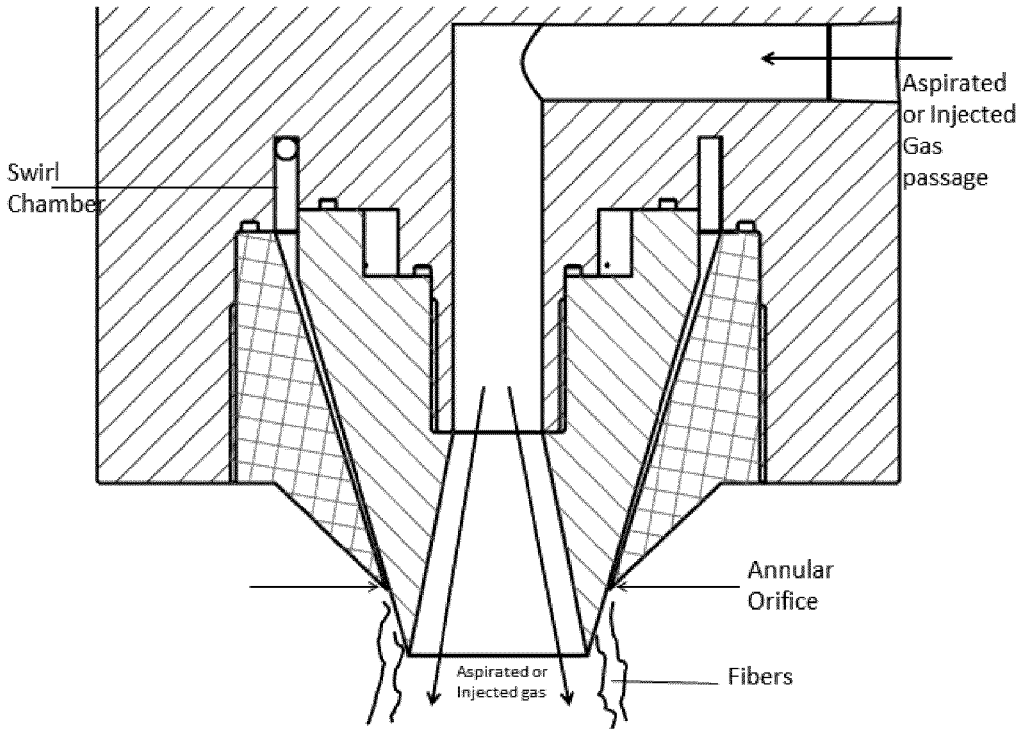
FIG. 32 is a cross-section of a two-phase flow nozzle according to the disclosure in Example 21.

A stainless steel reactor vessel (volume=0.5 l) was charged with 105 g of Capa 6100 polycaprolactone polymer (Perstorp), 45 g of Capa 6500 polycaprolactone polymer (Perstorp), The mixture was heated to 160 C and pressurized to 60 psig. The heated and pressurized mixture was forced through a 140 micron rated filter and then into the two-phase nozzle as shown in FIG. 32. Heated air was injected into the two-phase chamber at 245 C and 80 psig. The fiber flowrate was 0.141 g/min. The fibers produced were collected on a moving scrim of Reemay® as it passed over a vacuum box. The exit of the two-phase nozzle was 18 inches from the collecting surface. The machine-direction (MD) uniformity of the collected sheet material was measured by weighing 0.5 inch squares in lanes in the MD. Three lanes were measured, each with 14 squares. The sample uniformity index, UI, was calculated to be 5.6 (see definition of UI.)

What is claimed is:

1. A process for producing nanofibers from a two-phase nozzle comprising the steps of:

a) supplying a first phase comprising a polymer melt and a second phase comprising a pressurized gas stream to a two-phase flow nozzle;

b) injecting the polymer melt and the pressurized gas stream into a mixing chamber within the two-phase flow nozzle wherein the mixing chamber combines the polymer flow and pressurized gas into a two-phase flow;

c) distributing the two-phase flow uniformly to a converging channel terminating into an channel exit wherein the converging channel accelerates the two-phase flow creating a polymeric film along the surface of the converging channel;

d) fibrillating the polymeric film at the channel exit of the converging channel in the form of a plurality of nanofibers.

2. The method of claim 1, wherein the pressurized gas stream is heated to a temperature above the melting temperature of the polymer.

3. The method of claim 1 wherein the two-phase flow is rotational.

4. The method of claim 1, wherein the converging channel has a conical geometry.

5. The method of claim 1, wherein the channel exit is an annulus.

6. The method of claim 1 wherein the polymer is injected into the mixing chamber through multiple orifices equally spaced around a cylindrical polymer feed tube.

7. The method of claim 1 wherein the machine direction uniformity index (MDUI) of the nanofibrous material is less than 2.

8. The method claim 1 where an electrical current is applied between the spin nozzle and the collection surface.

9. The method of claim 1 wherein the plurality of nanofibers are collected on a collection surface located between 12 and 28 inches from the annular orifice.

10. The method of claim 1 wherein vacuum is applied to the collection surface from the side opposite the collection surface at a sufficient level to cause the material to be pinned to the collection surface.

* * * * *